US008883662B2

(12) United States Patent
Tanaka et al.

(10) Patent No.: US 8,883,662 B2
(45) Date of Patent: Nov. 11, 2014

(54) LEATHER-LIKE SHEET BEARING GRAIN FINISH AND PROCESS FOR PRODUCING THE SAME

(75) Inventors: Jiro Tanaka, Okayama (JP); Tsuyoshi Yamasaki, Okayama (JP); Yoshiyuki Ando, Okayama (JP); Norio Makiyama, Okayama (JP); Kimio Nakayama, Kurashiki (JP)

(73) Assignee: Kuraray Co., Ltd., Kurashiki-shi (JP)

( * ) Notice: Subject to any disclaimer, the term of this patent is extended or adjusted under 35 U.S.C. 154(b) by 847 days.

(21) Appl. No.: 12/593,399

(22) PCT Filed: Mar. 28, 2008

(86) PCT No.: PCT/JP2008/056037

§ 371 (c)(1),
(2), (4) Date: Sep. 28, 2009

(87) PCT Pub. No.: WO2008/120702

PCT Pub. Date: Oct. 9, 2008

(65) Prior Publication Data

US 2010/0086738 A1 Apr. 8, 2010

(30) Foreign Application Priority Data

| | | |
|---|---|---|
| Mar. 30, 2007 | (JP) | 2007-094588 |
| Mar. 30, 2007 | (JP) | 2007-094589 |
| Mar. 30, 2007 | (JP) | 2007-094590 |
| Mar. 30, 2007 | (JP) | 2007-094591 |
| Mar. 30, 2007 | (JP) | 2007-094592 |
| Mar. 30, 2007 | (JP) | 2007--094593 |

(51) Int. Cl.

| | |
|---|---|
| ***B32B 5/26*** | (2006.01) |
| ***B32B 27/02*** | (2006.01) |
| ***D04H 3/00*** | (2012.01) |
| ***D04H 5/00*** | (2012.01) |
| ***D04H 13/00*** | (2006.01) |
| ***D06N 3/00*** | (2006.01) |
| ***D06N 7/04*** | (2006.01) |
| ***D06N 3/04*** | (2006.01) |
| ***D06N 3/14*** | (2006.01) |

(52) U.S. Cl.

CPC ..... *D06N 3/0004* (2013.01); *D06N 3/042* (2013.01); *D06N 3/14* (2013.01); *Y10S 428/904* (2013.01)

USPC ..... 442/346; 442/168; 442/340; 442/351; 442/363; 442/392; 428/151; 428/904

(58) Field of Classification Search

USPC ..... 428/151, 904; 442/164, 168, 340, 363, 442/392, 346, 351

See application file for complete search history.

(56) References Cited

U.S. PATENT DOCUMENTS

| | | | | |
|---|---|---|---|---|
| 2002/0081418 | A1* | 6/2002 | Iijima et al. | 428/904 |
| 2004/0224122 | A1* | 11/2004 | Yamasaki et al. | 428/96 |
| 2005/0085592 | A1* | 4/2005 | Taniguchi et al. | 525/242 |
| 2006/0008631 | A1 | 1/2006 | Takeyama et al. | |
| 2007/0231547 | A1 | 10/2007 | Makimura et al. | |
| 2008/0095972 | A1* | 4/2008 | Yasuda et al. | 428/85 |
| 2008/0102245 | A1 | 5/2008 | Mimura et al. | |
| 2009/0053948 | A1 | 2/2009 | Fujisawa et al. | |
| 2009/0087618 | A1 | 4/2009 | Fujisawa et al. | |
| 2009/0124156 | A1 | 5/2009 | Fujisawa et al. | |
| 2009/0274862 | A1 | 11/2009 | Nakayama et al. | |

FOREIGN PATENT DOCUMENTS

| | | |
|---|---|---|
| CN | 1233298 A | 10/1999 |
| CN | 1539038 A | 10/2004 |
| CN | 1651644 A | 8/2005 |
| CN | 1675428 A | 9/2005 |
| EP | 0 165 345 | 12/1985 |
| JP | 59 150133 | 8/1984 |
| JP | 61 285268 | 12/1986 |
| JP | 63 5518 | 2/1988 |
| JP | 1 139877 | 6/1989 |
| JP | 1 266283 | 10/1989 |
| JP | 3 25551 | 4/1991 |
| JP | 4 185777 | 7/1992 |
| JP | 8 41786 | 2/1996 |
| JP | 9 59882 | 3/1997 |

| | | | | | |
|---|---|---|---|---|---|
| JP | 9 188975 | | | 7/1997 | |
| JP | 3046174 | | | 5/2000 | |
| JP | 3187357 | | | 7/2001 | |
| JP | 2002 30580 | | | 1/2002 | |
| JP | 2004 197232 | | | 7/2004 | |
| JP | 2004 300656 | | | 10/2004 | |
| JP | 2006 89863 | | | 4/2006 | |
| JP | 2007 046183 | | | 2/2007 | |
| JP | 2007 056417 | | | 3/2007 | |
| TW | 200415284 | A | | 8/2004 | |
| WO | 2005 106108 | | | 11/2005 | |
| WO | WO 2005124002 | A1 | * | 12/2005 | ..... D04H 3/00 |

OTHER PUBLICATIONS

Computerized English translation to JP 2007-046183 A to Ueno et al., Feb. 22, 2007, obtained from Japanese Patent Office website.*

U.S. Appl. No. 12/161,013, filed Jul. 16, 2008, Fujisawa, et al.

U.S. Appl. No. 13/638,759, filed Oct. 1, 2012, Nakayama, et al.

Combined Taiwanese Office Action and Search Report issued Sep. 6, 2013, in Taiwanese Patent Application No. 097111473 with English translation of category of cited documents.

* cited by examiner

*Primary Examiner* — Jeremy R Pierce

(74) *Attorney, Agent, or Firm* — Oblon, Spivak, McClelland, Maier & Neustadt, L.L.P.

(57) ABSTRACT

A (semi)grain-finished leather-like sheet composed of an entangled nonwoven fabric of three-dimensionally entangled fiber bundles containing microfine long fibers and an elastic polymer contained in the entangled nonwoven fabric. When dividing the (semi)grain-finished leather-like sheet to five layers with equal thickness, i.e., surface layer, substrate layer 1, substrate layer 2, substrate layer 3 and back layer in this order along the thickness direction, part of the microfine long fibers forming the surface layer and/or the back layer are fuse-bonded to each other and the microfine long fibers forming the intermediate layer are not fuse-bonded. With such a fuse-bonding state of the microfine long fibers, the (semi) grain-finished leather-like sheet combines a low compression resistance and a dense feel each comparable to natural leathers, has a sufficient practical strength, and are excellent in properties which are required according to its use.

21 Claims, 3 Drawing Sheets

LEATHER-LIKE SHEET BEARING GRAIN FINISH AND PROCESS FOR PRODUCING THE SAME

This application is a National Stage (371) of PCT/JP08/56037 filed Mar. 28,2008, and claims priority to: JP 2007-094588, JP 2007-094589, JP 2007-094590, JP 2007-094591, JP 2007-094592, and JP 2007-094593, each filed on Mar. 30, 2007.

TECHNICAL FIELD

The present invention relates to grain-finished leather-like sheets resembling natural leathers and a production method thereof. More specifically, the present invention relates to grain-finished leather-like sheets which combine a low compression resistance and a dense feel each being comparable to natural leathers, have a sufficient practical strength and form fine bent wrinkles resembling those of natural leathers, and further relates to a rational and environmentally friend production method thereof.

The present invention further relates to aesthetically appealing grain-finished leather-like sheets in which the color shade at folded portion, stretched portion or compressed portion varies during the use in various applications, to give a natural unevenness closely resembling natural leathers. More particularly, the present invention relates to grain-finished leather-like sheets having a pull-up effect and dense feel each resembling natural leathers, a softness and a sufficient practical strength, and relates to a rational and environmentally friend production method thereof.

The present invention still further relates to grain-finished leather-like sheets little causing a damp and hot feeling under wearing and a rational and environmentally friend production method thereof.

The present invention still further relates to grain-finished leather-like sheets with a good wet grippability and nonslip products made of the grain-finished leather-like sheets.

The present invention still further relates to grain-finished leather-like sheet resembling natural leathers which exhibit a good strength after cut into thin strings or strips and a production method thereof.

The present invention still further relates to semigrain-finished leather-like sheets which easily present a used and aged appearance resembling natural leathers, i.e., an antique appearance and a production method thereof.

BACKGROUND ART

Various types of leather-like sheets having a flexibility resembling natural leathers have been known. For example, a leather-like sheet which is produced by impregnating a polyurethane resin into an entangled nonwoven fabric made of microfine fibers of 1 dtex or less and laminating a film formed by coating a polyurethane resin on a release paper to a substrate obtained by wet-coagulating the impregnated polyurethane resin; a leather-like sheet which is produced by applying a polyurethane solution on a substrate obtained in the same manner as above, wet-coagulating the impregnated polyurethane solution, and then gravure-coating a colorant for the polyurethane resin; and a leather-like sheet which is produced by impregnating a polyurethane resin into an entangled nonwoven fabric made of sea-island fibers, wet-coagulating the impregnated polyurethane resin, converting the sea-island fibers to bundles of microfine fibers with a fineness of 0.2 de or less by removing one component from the sea-island fibers by resolution in a solvent thereby to obtain a substrate made of the bundles of microfine fibers, and then finishing the surface have been proposed (Patent Document 1). However, these leather-like sheets have a strong rubbery compression resistance which is characteristic of polyurethane resins. Thus, a leather-like sheet combining a low compression resistance and a dense feel each resembling natural leathers and having an appearance of fine bent wrinkles and a sufficient practical strength has not yet been obtained (Patent Documents 2 to 4).

The above leather-like sheets are produced by a method using a large amount of organic solvents. Such a method is complicated to increase the production costs and the lead time is necessarily prolonged. In the surface formation (formation of a grain surface layer) by a release paper method or a gravure coating method, a water dispersion of an elastic polymer may be used. However, the elastic polymer in the water dispersion is less compatible with the elastic polymer in the entangled nonwoven fabric. In addition, the grain surface layer is likely to be peeled off along the interface between the grain surface layer and the entangled nonwoven fabric because the water-dispersed elastic polymer is less cohesive, thereby failing to show a sufficient surface strength. If a production line using organic solvent widely employed is used as a production line using a water-dispersed elastic polymer, volatile organic compounds (VOC) are emitted. To achieve a production method with a low VOC emission and a small environmental load, a new line must be constructed to increase the initial investment. Therefore, an environmentally friend, rational production method of grain-finished artificial leathers have been demanded. However, a production method which meets the demand has not yet been proposed.

Artificial leathers composed of a fibrous substrate and an elastic polymer have been widely used as a substitute for natural leathers in the production of sheet materials for interior, upper material for shoes, sub-material for shoes, and material for clothes and pouches. Of suede-finished artificial leathers, nubuck-finished artificial leathers and grain-finished artificial leathers, the grain-finished artificial leathers are widely used for the application of shoes, balls, clothes, pouches, and interior. To make a grain-finished artificial leather aesthetically appealing, the color and pattern of its surface are made imitative of those of natural leather surface by a surface finishing according to its application. A surface finish resembling so-called pull-up natural leathers, in which the pull-up oil added to leather moves upon bending to generate natural unevenness because of the change of color shade at the bending portion, have been attempted in various applications. However, it was found to be not practical for known leather-like sheet because the surface strength was poor. In view of the environmental protection, an environmentally friend method has been recently required also in the production of leather-like sheets. However, in the known production methods of leather-like sheets, the use of organic solvents is needed to dissolve resins. The organic solvents may injure worker's health and the emitted organic solvents may cause atmospheric pollution.

To enhance the aesthetical appeal of a grain-finished artificial leather, Patent Document 4 proposes the use of a surface coating agent mainly composed of a polyurethane resin and blended with polybutylene and silica. Patent Document 5 proposes to impregnate an oil-soluble surfactant into an artificial leather. However, the proposed methods cannot reproduce the natural, massive, oil-up feeling of natural leathers.

Patent Document 6 proposes to coat artificial leather with wax to improve the color fastness of suede-finished artificial leathers. It is described that a nap-finished sheet with a good color fastness is obtained by coating a napped surface of microfine fibers with wax, heat-treating to raise the napped fibers laid down by wax, and then brushing. Thus, the technique proposed by Patent Document 6 is irrelevant to the oil-up effect.

Patent Document 7 describes that the color lightness reversibly changes upon bending when the open pores in a porous polyurethane layer of a grain-finished artificial leather is filled up with a wax with a melting point of 40 to 100° C. However, the open pores in the porous polyurethane layer are formed by a mechanical abrasion and a wax solution in an organic solvent should be used to fill up the open pores with wax. Therefore, the propose method should use, in addition to wax, a harmful organic solvent and include complicated production steps.

Patent Document 8 proposes a leather-like sheet which is covered with a nap of colored microfine fibers with a fineness of 0.1 dtex or less and a polymer which is solid at ordinary temperatures and has a melting point of 60° C. or higher and an elongation at break of 10% or less. It is taught that a color shade is obtained according to the degree of separation between the polymer and the microfine fibers and the degree of cracking of the polymer. However, the polymer which is solid at ordinary temperatures and brittle inevitably falls off from the surface layer, and therefore, the proposed leather-like sheet cannot withstand a long-term use.

Patent Document 9 describes a leather-like sheet which is composed of a substrate made of a fiber assembly and a polymer coating layer, a colorant-containing polyurethane elastomer layer (I) on the surface of the substrate, and a colorant-containing polyurethane elastomer layer (II) on the polyurethane elastomer layer (I). It is described that a massive color change is obtained by partly abrading the polyurethane elastomer layer (II) to expose the polyurethane elastomer layer (I). However, as compared with the color shade of natural leathers, the obtained color change is still artificial and the aesthetic appearance resembling natural leathers is not obtained.

As mentioned above, artificial leathers have found a wide application such as sport shoes, clothes, and gloves because of their softness, high quality and easy care. In view of recently increasing requirements of customers to the variety of feeling and performance, it is required to provide leather goods having a feeling and performance ever known. For example, during the use of sport shoes and gloves, the wearer's sweat and the increase in the inner temperature cause an unpleasant damp and hot feeling on feet and hands. To reduce the unpleasant damp and hot feeling under wearing, various artificial leathers have been proposed (Patent Documents 10 and 11). However no satisfactory artificial leather in practical use is obtained.

Various leather-like sheets have been proposed as the substitutes for natural leathers. Materials for grips of golf clubs and tennis rackets, materials for game balls, and materials for heals and soles of shoes are required to be well grippable in both the conditions where the surface is dry or the surface is wet by sweat or rain. For example, a number of pebbles (embosses) of a size of about 3.0 $mm^2$ are provided on the surface of basket balls. However, since the handling ability and grippability during play are not sufficiently improved by only forming pebbles, it has been widely employed to coat the surface with a resin to improve the handling ability and grippability. However, the grippability in wet condition is not improved by only coating a resin, and the grippability is remarkably reduced by sweat during play. To improve the grippability in wet condition, there have been made many proposals to provide microholes for absorbing water and sweat on the upper or side surface of pebbles formed on the surface of materials.

Patent Document 12 describes to form a pebble-valley pattern on the surface by embossing and form microholes on the pebbles by buffing with sandpaper or a card clothing or by dissolving the surface with a solvent. Patent Document 13 describes a leather-like sheet which is produced by applying an elastic polymer on the surface of a substrate composed of microfine fibers and an elastic polymer, forming a pebble-valley pattern on the surface by an emboss roll, and then, forming a coating layer of an elastic polymer on the top surface of pebbles. The side wall between the top surface of pebble and the surface of valley has through holes which extend from the surface layer to the substrate layer. It is described that the through holes are formed by extending the side wall of pebbles during the emboss treatment.

However, the proposed leather-like sheet is still insufficient in the wet grippability. In addition, since the difference between the dry grippability and the wet grippability is large, the handling ability remarkably changes during play. Further, additional production steps are necessary to form the microholes and through holes. Therefore, it is required to improve the production efficiency.

Artificial leather strings obtained by cutting a leather-like sheet having a softness resembling natural leathers have been used in the production of clothes and woven or knitted fabrics for interior goods, or used as laces for shoes, bags and baseball gloves or braids for fancyworks. However, the artificial leather strings obtained by cutting a known leather-like sheet have a poor strength. Thus, an artificial leather string having a strength comparable to the strings obtained by cutting natural leathers have not yet been obtained.

Patent Document 14 discloses a leather string-like yarn composed of a fibrous substrate having a grain surface on its one surface, which has different colors on its two surfaces. It is described that the leather string-like yarn has excellent mechanical properties such as a high strength, an improved elasticity and an improved firmness. However, there is no objective evidence to show such excellent mechanical properties.

Natural leathers produce fine wrinkles in every direction on its surface with use for a long time and show antique appearance. Natural leather products having an antique appearance and an attractive vintage feel are accepted by many users as high quality fancy goods. Therefore, it has been required in the field of artificial leathers to develop a leather-like sheet which can form an antique appearance resembling natural leathers. To meet the requirement, various semigrain-finished leather-like sheets have been proposed. The proposed semigrain-finished leather-like sheets are produced by a production method including a step of raising the surface of a fibrous substrate by buffing and a step of applying the napped surface with an elastic polymer to control the length of napped fibers. However, the semigrain-finished leather-like sheet produced by such a method has a hard, rubbery and plastic surface because the surface is covered with a continuous film of the elastic polymer. Therefore, such a semigrain-finished leather-like sheet forms only wrinkles which are seen artificial at a glance even after a long term use, and a well-worn antique appearance resembling natural leathers is not obtained.

Patent Document 15 discloses a leather-like sheet having a coating layer with a micro joint structure on at least one surface of the substrate. The coating layer with a micro joint structure is formed by mechanically and/or chemically finely dividing a continuous film formed on at least one surface of the substrate. It is described that the micro joint structure provides an extremely natural appearance not ever obtained. However, it is still difficult to form an antique appearance resembling natural leathers on the surface of the proposed leather-like sheet.

The known leather-like sheets are all produced by methods using many organic solvents. In addition, the known methods include complicated production steps, this increasing production costs and necessarily resulting in a long lead time. In the surface forming step (step of forming a grain surface layer) by a release paper method or a gravure coating method, a water dispersion of an elastic polymer is usable. However, the elastic polymer for the grain surface is less compatible with the elastic polymer in an entangled nonwoven fabric. In addition, since the water-dispersed elastic polymer is less cohesive, the grain surface is easy to peel off from the entangled nonwoven fabric at their boundary, thereby failing to obtain a sufficient surface strength. If a production line using organic solvent usually employed is used as a production line using a water-dispersed elastic polymer, volatile organic compounds (VOC) are emitted. To achieve a production method with a low VOC emission and a small environmental load, a new line must be constructed to increase the initial investment. Therefore, an environmentally friend, rational production method of semi grain-finished artificial leathers have been demanded. However, a production method which meets the demand has not yet been proposed.

Patent Document 1: JP 63-5518B
Patent Document 2: JP 4-185777A
Patent Document 3: Japanese Patent 3187357
Patent Document 4: JP 61-285268A
Patent Document 5: JP 1-139877A
Patent Document 6: JP 3-25551B
Patent Document 7: Japanese Patent 3046174
Patent Document 8: JP 2002-30580A
Patent Document 9: JP 1-266283A
Patent Document 10: JP 8-41786A
Patent Document 11: JP 9-59882A
Patent Document 12: JP 2004-300656A
Patent Document 13: JP 2006-89863A
Patent Document 14: JP 59-150133A
Patent Document 15: JP 9-188975A

DISCLOSURE OF THE INVENTION

An object of the present invention is to solve the above problems and provide a grain-finished leather-like sheet having properties more resembling natural leathers than ever and provide a method of producing the grain-finished leather-like sheet in an environmentally friend manner.

Another object of the present invention is to provide an aesthetically appealing grain-finished leather-like sheet which changes color shade by bending, stretching and compressing during its use and shows natural unevenness well resembling natural leathers. Still another object is to provide an aesthetically appealing grain-finished leather-like sheet combining a pull-up property, a dense feel, a softness and a sufficient practical strength each resembling natural leathers. Still another object is to provide a method of producing the grain-finished leather-like sheets mentioned above without using organic solvents.

Still another object of the present invention is to provide a grain-finished leather-like sheet which has properties well resembling natural leathers than ever and reduces the damp and hot feeling of artificial leather products much more than ever, and to provide a method of producing the grain-finished leather-like sheet in an environmentally friend manner.

Still another object of the present invention is to solve the above problems and provide a grain-finished leather-like sheet having a good wet grippability and nonslip products made of the grain-finished leather-like sheet.

Still another object of the present invention is to provide a grain-finished leather-like sheet which can be made into strings having a high strength by cutting and a method of producing the grain-finished leather-like sheet in an environmentally friend manner.

Still another object of the present invention is to provide a semigrain-finished leather-like sheet which easily creates an antique appearance resembling that of natural leathers and a method of producing the semigrain-finished leather-like sheet in an environmentally friend manner.

As a result of extensive research, the inventors have found grain-finished leather-like sheets achieving the above objects and environmentally friend production methods thereof. The present invention has accomplished by these findings.

Namely, the present invention relates to a grain-finished leather-like sheet which comprises an entangled nonwoven fabric comprising three-dimensionally entangled bundles of microfine long fibers and an elastic polymer contained in the entangled nonwoven fabric, the grain-finished leather-like sheet simultaneously satisfying the following requirements 1 to 3:

(1) an average fineness of the microfine long fibers is 0.001 to 2 dtex;

(2) an average fineness of the bundles of the microfine long fibers is 0.5 to 10 dtex; and (3) at least part of the microfine long fibers which form a surface layer and a back layer are fuse-bonded to each other, and the microfine long fibers which form a substrate layer 2 are not fuse-bonded, when the grain-finished leather-like sheet is divided to five layers with equal thickness, surface layer, substrate layer 1, substrate layer 2, substrate layer 3 and back layer, in this order along a thickness direction thereof.

The present invention further relates to a grain-finished leather-like sheet which simultaneously satisfies, in addition to the requirements 1 to 3, the following requirement 4:

(4) the elastic polymer is a (meth)acrylic elastic polymer having a hot-water swelling at 130° C. of 10% or more, a peak temperature of loss elastic modulus of 10° C. or less, a tensile strength at 100% elongation of 2 N/cm$^2$ or less, and an elongation at tensile break of 100% or more.

The present invention further relates to a grain-finished leather-like sheet which simultaneously satisfies the requirement 1 wherein the average fineness is 0.001 to 0.5 dtex, the requirement 2 wherein the average fineness of the bundles of microfine long fibers is 0.5 to 4 dtex, the requirement 3, and further, the following requirements 4 and 5:

(4) fine voids surrounded by the microfine fibers having a maximum width of 0.1 to 50 μm and a minimum width of 10 μm or less exist 8000 or more per 1 cm$^2$ of surface, and (5) a surface abrasion loss is 30 mg or less when measured by Martindale method under a load of 12 kPa (gf/cm$^2$) at 50,000 times of abrasions.

The present invention further relates to a grain-finished leather-like sheet which simultaneously satisfies the requirement 1 wherein the average fineness is 0.005 to 2 dtex, the requirement 2 wherein the average fineness of the bundles of microfine long fibers is 1.0 to 10 dtex, the requirement 3, and further, the following requirement 4:

(4) a static coefficient of friction and a dynamic coefficient of friction of a surface of the grain-finished leather-like sheet satisfy the following formula I and II:

$$\text{static coefficient of friction(wet)} \geq \text{static coefficient of friction(dry)} \quad \text{(I)}$$

$$\text{dynamic coefficient of friction(wet)} \geq \text{dynamic coefficient of friction(dry)} \quad \text{(II)}.$$

The present invention further relates to a grain-finished leather-like sheet which simultaneously satisfies the requirement 1 wherein the average fineness is 0.005 to 2 dtex, the requirement 2, the requirement 3, and further, the following requirements 4 and 5:

(4) an apparent density of the grain-finished leather-like sheet is 0.5 g/cm$^3$ or more, and (5) a string of the grain-finished leather-like sheet having a width of 5 mm, which is obtained by cutting the grain-finished leather-like sheet along a machine direction (MD) or a crossing direction (CD), has a breaking strength of 1.5 kg/mm$^2$ or more (20 kg or more).

The present invention further relates to a semigrain-finished leather-like sheet which simultaneously satisfies the requirement 1, the requirement 2, the requirement 3, and further, the following requirement 4:

(4) microfine long fibers separated from the bundle extend substantially in a horizontal direction on an outer surface of the surface layer and/or the back layer and cover 50% by area or less of the outer surface, wherein a bundle in first to tenth bundles in a thickness direction from the outer surface of the semigrain-finished leather-like sheet is separated into the microfine long fibers.

The present invention further relates to a method of producing a grain-finished leather-like sheet which comprises the following sequential steps:

(1) a step of producing a long fiber web comprising microfine fiber bundle-forming long fibers by using sea-island long fibers;

(2) a step of producing an entangled web by entangling the long fiber web;

(3) a step of producing an entangled nonwoven fabric by removing a sea component from the microfine fiber bundle-forming long fibers in the entangled web, thereby converting the microfine fiber bundle-forming long fibers to bundles having an average single fiber fineness of 0.5 to 10 dtex and containing microfine long fibers having an average fineness of 0.001 to 2 dtex;

(4) a step of providing the entangled nonwoven fabric with an aqueous dispersion or aqueous solution of an elastic polymer in an elastic polymer/microfine long fiber mass ratio of 0.001 to 0.6, and allowing the elastic polymer to migrate to both surfaces (top surface and back surface) of the entangled nonwoven fabric and coagulate under heating; and (5) a step of forming a grain surface by hot pressing at least one surface of the leather-like sheet at a temperature which is 50° C. or more lower than a spinning temperature of the sea-island long fibers and equal to or less than a melting point of the elastic polymer.

When the grain-finished leather-like sheet of the invention is divided to five layers with equal thickness, i.e., surface layer, substrate layer 1, substrate layer 2, substrate layer 3 and back layer, in this order along the thickness direction, part of the microfine long fibers forming the surface layer and the back layer are fuse-bonded to each other, but the microfine long fibers forming the substrate layer 2 are not fuse-bonded. With such a fuse-bonding state of the microfine long fibers, the grain-finished leather-like sheet of the invention combines a low compression resistance and a dense feel each comparable to natural leathers, has a sufficient practical strength, and forms fine bent wrinkles resembling natural leathers.

The grain-finished leather-like sheet of the invention exhibits an aesthetic appearance having a natural unevenness well resembling natural leathers when a specific (meth) acrylic elastic polymer is used as the elastic polymer.

According to the present invention, a grain-finished leather-like sheet which has properties well resembling natural leathers than ever and reduces the damp and hot feeling of artificial leather products much more than ever is provided. Also, a method of producing such a grain-finished leather-like sheet in an environmentally friend manner is provided. In addition, an artificial leather product with reduced damp and hot feeling is provided.

The present invention provides a grain-finished leather-like sheet having a coefficient of friction in wet condition which is equal to or higher than that in dry condition and a good grippability even in wet condition.

The present invention provides a grain-finished leather-like sheet capable of giving artificial leather strings by cutting which have strength comparable to that of natural leather strings.

Further, the present invention provides a semigrain-finished leather-like sheet in which part of the bundles of microfine fibers on the outermost surface portion of the surface layer and the back layer are separated into microfine fibers. With such a fibrous structure, the semigrain-finished leather-like sheet of the invention easily acquires an antique appearance well resembling natural leathers without using for a long term.

BEST MODE FOR CARRYING OUT THE INVENTION

Figure 1:
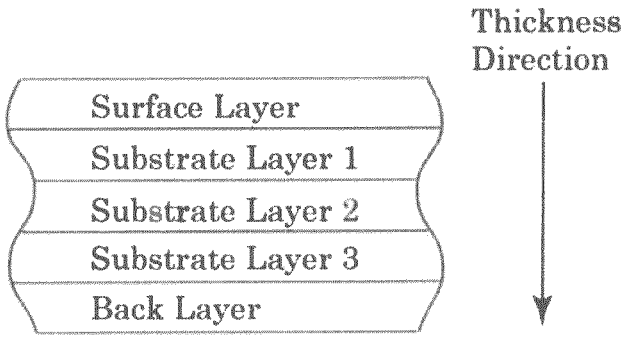
FIG. 1 is a schematic illustration showing the division of the grain-finished leather-like sheet of the invention into five layers with equal thickness.

The (semi)grain-finished leather-like sheet of the present invention comprises an entangled nonwoven fabric comprising three-dimensionally entangled fiber bundles containing microfine long fibers and an elastic polymer contained in the entangled nonwoven fabric, and simultaneously satisfies the following requirements 1 to 3:

(1) an average fineness of the microfine long fibers is 0.001 to 2 dtex;

(2) an average fineness of the fiber bundles of the microfine long fibers is 0.5 to 10 dtex; and (3) at least part of the microfine long fibers which form a surface layer are fuse-bonded to each other, and the microfine long fibers which form a substrate layer 2 are not fuse-bonded, when the grain-finished leather-like sheet is divided to five layers with equal thickness, i.e., surface layer, substrate layer 1, substrate layer 2, substrate layer 3 and back layer, in this order along the thickness direction thereof.

The (semi)grain-finished leather-like sheet of the invention is produced by a method including the following sequential steps:

(1) a step of producing a long fiber web comprising microfine fiber bundle-forming long fibers by using sea-island long fibers;

(2) a step of producing an entangled web by entangling the long fiber web;

(3) a step of producing an entangled nonwoven fabric by removing a sea component from the microfine fiber bundle-forming long fibers in the entangled web, thereby converting the microfine fiber bundle-forming long fibers to bundles having an average single fiber fineness of 0.5 to 10 dtex and containing microfine long fibers having an average fineness of 0.001 to 2 dtex;

(4) a step of providing the entangled nonwoven fabric with an aqueous dispersion of an elastic polymer in an elastic polymer/microfine long fiber mass ratio of 0.001 to 0.6, and allowing the elastic polymer to migrate to both surfaces (top surface and back surface) of the entangled nonwoven fabric and coagulate under heating, thereby obtaining a leather-like sheet; and (5) a step of forming a grain surface by hot pressing both surfaces of the leather-like sheet at a temperature which is 50° C. or more lower than a spinning temperature of the sea-island long fibers and equal to or less than a melting point of the elastic polymer.

Each step and the fiber assemblies obtained in each step will be described in detail below.

In Step 1, a long fiber web comprising microfine fiber bundle-forming long fibers is produced by using sea-island long fibers. The sea-island fibers are multi-component composite fibers made of at least two kinds of polymers and have a cross section in which an island component polymer is dispersed in a sea component polymer of different kind. The sea-island long fibers are, after formed into an entangled nonwoven fabric and before impregnating an elastic polymer, converted to bundles of microfine long fibers made of the island component polymer by removing the sea component polymer by extraction or decomposition.

The island component polymer is selected from known fiber-forming, water-insoluble, thermoplastic polymers. Examples thereof include, but not limited to, polyester resins such as polyethylene terephthalate (PET), polytrimethylene terephthalate (PTT), polybutylene terephthalate (PBT), polyester elastomers and their modified products; polyamide resins such as nylon 6, nylon 66, nylon 610, nylon 12, aromatic polyamide, semi-aromatic polyamide, polyamide elastomers and their modified products; polyolefin resins such as polypropylene; and polyurethane resins such as polyester-based polyurethane. Of these polymers, the polyester resins such as PET, PTT, PBT, and modified products thereof are preferred particularly in respect of being easily shrunk upon heating and providing artificial leather products having a hand with dense feeling and good practical performances such as abrasion resistance, fastness to light, and shape retention. The polyamide resins such as nylon 6 and nylon 66 are hygroscopic as compared with the polyester resins and produce flexible, soft microfine long fibers. Therefore, the polyamide resins are preferred particularly in respect of providing artificial leather products having a soft hand with fullness and good practical performances such as antistatic properties.

The island component polymer preferably has a melting point of 160° C. or higher, and more preferably a crystallizable polymer having a melting point of 180 to 330° C. In the present invention, as described below, the melting point of polymer is expressed by the top temperature of endothermic peak (melting peak) obtained in the second run of differential scanning calorimetry. The island component polymer used in the present invention preferably has another endothermic peak (endothermic subpeak) in addition to the melting peak in the first run of differential scanning calorimetry. Having the endothermic subpeak, part of the microfine fibers on the surface are fuse-bonded to each other without heating to a temperature higher than the melting point of the island component polymer, thereby easily forming a grain surface (fiber grain surface). Therefore, a grain-finished leather-like sheet combining a good surface property and a soft hand comparable to that of natural leathers is obtained.

The temperature of endothermic subpeak of the island component polymer is preferably lower than the melting point by 30° C. or more, more preferably by 50° C. or more, because the microfine fibers are easily fuse-bonded to each other without deteriorating the hand. The lower limit of the temperature of endothermic subpeak is not specifically limited, and the production is successfully performed even when the temperature of endothermic subpeak is lower than the melting point by 160° C. or more.

The intensity of the endothermic subpeak is preferably lower than that of the melting peak because a good surface property, a good grain-finished appearance and a good hand are combined. If the intensity of the endothermic subpeak is higher than that of the melting peak, the surface property tends to be lowered although the grain-finished appearance is obtained. The intensity of the endothermic subpeak is preferably 1/2 or less, more preferably 1/3 or less of that of the melting peak, because the microfine fibers on the surface are moderately fuse-bonded to each other, and a good grain-finished appearance, a good hand and a good surface property are combined. The lower limit of the intensity of the endothermic subpeak is not particularly limited as long as the effect of the invention is obtained, and preferably 1/200 or more of that of the melting peak because the grain-finished appearance is easily obtained. The area ratio of the melting peak and the endothermic subpeak is preferably 100/1 or less, more preferably 50/1 or less, and still more preferably 25/1 or less.

The absorbed heat (peak area) of the endothermic subpeak decreases when heated to a temperature higher than the temperature of the endothermic subpeak, and when heated to 175° C. or higher the area of endothermic subpeak of the island component polymer may be reduced to 1/2 or less of the area before heating.

As describe above, the endothermic subpeak tends to become smaller by heating. Therefore, it is preferred that both the island component polymers for use as a raw material and forming the microfine long fibers exhibit the endothermic subpeak, because the microfine fibers are easily fuse-bonded to each other. Therefore, preferably used in the present invention is an island component polymer which exhibits the endothermic peak together with the melting peak in first run of differential scanning calorimetry which is measured immediately after the conversion to the microfine long fibers.

As the island component polymer exhibiting the melting peak and the endothermic subpeak, the modified products of: polyester resins, polyamide resins, polyolefin resins, and polyurethane resins as mentioned above are preferably used. Of these resins, modified polyester resins are preferred and isophthalic acid-modified polyester resins are more preferred, because the surface property, hand, and easy-to-fuse-bonding property are combined. To exhibit the endothermic subpeak after heating, the modified polymer is preferably partially oriented by a known method.

The island component polymer may be added with colorant, ultraviolet absorber, heat stabilizer, deodorant, fungicidal agent, antimicrobial agent and various stabilizers.

The sea component polymer is removed by extraction with a solvent or decomposition with a decomposer in the step of converting the sea-island long fibers to the bundles of microfine long fibers. Therefore, the sea component polymer is required to have a solubility to solvent or decomposability by decomposer higher than those of the island component polymer. In view of the spinning stability, the sea component polymer is preferably less compatible with the island component polymer, and its melt viscosity and/or surface tension is preferably smaller than those of the island component polymer under the spinning conditions. The sea component polymer is not particularly limited as long as the above preferred requirements are satisfied. Preferred examples include polyethylene, polypropylene, polystyrene, ethylene-propylene copolymer, ethylene-vinyl acetate copolymer, styrene-ethylene copolymer, styrene-acryl copolymer, and polyvinyl alcohol resin. A water-soluble, thermoplastic polyvinyl alcohol (water-soluble PVA) is preferably used as the sea component polymer, because the grain-finished leather-like sheet is produced without using organic solvents.

The viscosity average polymerization degree (polymerization degree of the water-soluble PVA is preferably 200 to 500, more preferably 230 to 470, and still more preferably 250 to 450. If being 200 or more, the melt viscosity is moderate, and the water-soluble PVA is easily made into a composite with the island component polymer. If being 500 or less, the melt viscosity is not excessively high and the extrusion from a spinning nozzle is easy. By using the water-soluble PVA having a polymerization degree of 500 or less, i.e., a low-polymerization degree PVA, the dissolution to a hot water becomes quick. The polymerization degree (P) of the water-soluble PVA is measured according to JIS-K6726, in which the water-soluble PVA is re-saponified and purified, and then, an intrinsic viscosity [η] is measured in water of 30° C. The polymerization degree (P) is calculated from the following equation:

$$P=([\eta]10^3/8.29)^{(1/0.62)}.$$

The saponification degree of the water-soluble PVA is preferably 90 to 99.99 mol %, more preferably 93 to 99.98 mol %, still more preferably 94 to 99.97 mol %, and particularly preferably 96 to 99.96 mol %. If being 90 mol % or more, the melt spinning is performed without causing thermal decomposition and gelation because of a good heat stability and the biodegradability is good. Also, the water solubility is not reduced when modified with a copolymerizable monomer which will be described below, and the conversion to microfine fibers becomes easy. A water-soluble PVA having a saponification degree exceeding 99.99 mol % is difficult to produce stably.

The melting point (Tm) of the water-soluble PVA is preferably 160 to 230° C., more preferably 170 to 227° C., still more preferably 175 to 224° C., and particularly preferably 180 to 220° C. If being 160° C. or higher, the fiber tenacity is prevented from being reduced due to the lowering of crystallizability and the fiber formation is prevented from becoming difficult because of the deteriorated heat stability. If being 230° C. or lower, the sea-island long fibers can be stably produced because the melt spinning can be performed at temperatures lower than the decomposition temperature of the water-soluble PVA.

The water-soluble PVA is produced by saponifying a resin mainly constituted by vinyl ester units. Examples of vinyl monomers for the vinyl ester units include vinyl formate, vinyl acetate, vinyl propionate, vinyl valerate, vinyl caprate, vinyl laurate, vinyl stearate, vinyl benzoate, vinyl pivalate and vinyl versatate, with vinyl acetate being preferred in view of easy production of the water-soluble PVA.

The water-soluble PVA may be homo PVA or modified PVA introduced with co-monomer units, with the modified PVA being preferred in view of a good melt spinnability, water solubility and fiber properties. In view of a good copolymerizability, melt spinnability and water solubility of fibers, preferred examples of the co-monomers are α-olefins having 4 or less carbon atoms such as ethylene, propylene, 1-butene and isobutene; and vinyl ethers such as methyl vinyl ether, ethyl vinyl ether, n-propyl vinyl ether, isopropyl vinyl ether and n-butyl vinyl ether. The content of the comonomer units derived from α-olefins and/or vinyl ethers is preferably 1 to 20 mol %, more preferably 4 to 15 mol %, and still more preferably 6 to 13 mol % based on the constitutional units of the modified PVA. Particularly preferred is an ethylene-modified PVA, because the fiber properties are enhanced when the comonomer unit is ethylene. The content of the ethylene units is preferably 4 to 15 mol % and more preferably 6 to 13 mol %.

The water-soluble PVA can be produced by a known method such as bulk polymerization, solution polymerization, suspension polymerization, and emulsion polymerization. Preferred are a bulk polymerization and a solution polymerization which are carried out in the absence of solvent or in the presence of a solvent such as alcohol. Examples of the solvent for the solution polymerization include lower alcohols such as methyl alcohol, ethyl alcohol and propyl alcohol. The copolymerization is performed in the presence of a known initiator, for example, an azo initiator or peroxide initiator such as a,a'-azobisisobutyronitrile, 2,2'-azobis(2,4-dimethyl-varelonitrile), benzoyl peroxide, and n-propyl peroxycarbonate. The polymerization temperature is not critical and a range of from 0 to 150° C. is recommended.

In the known production of artificial leathers, the microfine fiber bundle-forming long fibers are cut down to staples with a desired length, and the staples are made into a fiber web. In the present invention, the sea-island long fibers (microfine fiber bundle-forming long fibers) produced by a spun-bonding method, etc. are made into a long fiber web without cutting. The sea-island long fibers are melt-spun by extruding the sea component polymer and the island component polymer from a composite-spinning spinneret. The spinning temperature (spinneret temperature) is higher than the melting points of the polymers constituting the sea-island long fibers, and preferably 180 to 350° C., because the island component polymer well exhibits the melting peak and the endothermic subpeak. The molten sea-island long fibers extruded from the spinneret are cooled by a cooling apparatus, withdrawn to an intended fineness by air jet at a speed corresponding to a take-up speed of 1000 to 6000 m/min using a sucking apparatus, and then collected on a collecting surface such as a moving net, thereby obtaining a web composed of substantially non-drawn long fibers. The obtained long fiber web may be partially compressed by press to stabilize the shape. As compared with the production of short fiber webs, this method of producing long fiber webs is advantageous in productivity, because it does not need a series of large apparatuses such as a raw fiber feeder, an apparatus for opening fibers and a carding machine which are necessarily used in the production method of short fiber webs. In addition, since the long fiber web and the leather-like sheets made thereof are constituted by long fibers with high continuity, the properties such as strength are high as compared with those of the short fiber webs and the leather-like sheets made thereof which have been hitherto generally used.

The average cross-sectional area of the sea-island long fibers is preferably 30 to 800 $\mu m^2$. The average area ratio (corresponding to the volume ratio of polymers) of the sea component polymer and the island component polymer on the cross section of the sea-island long fibers is preferably 5/95 to 70/30. The mass per unit area of the obtained long fiber web is preferably 10 to 1000 $g/m^2$.

In the present invention, the term "long fiber" means a fiber longer than a short fiber generally having a length of about 3 to 80 mm and a fiber not intentionally cut as so done in the production of short fibers. For example, the length of the long fibers before converted to microfine fibers is preferably 100 mm or longer, and may be several meters, hundreds of meter, or several kilo-meters as long as being technically possible to produce or being not physically broken.

In Step 2, the long fiber web is entangled to obtain an entangled web. After superposed into layers by a crosslapper if necessary, the long fiber web is needle-punched simultaneously or alternatively from both surfaces so as to allow one or more barbs to penetrate through the web. The punching density is preferably 300 to 5000 punch/$cm^2$ and more preferably 500 to 3500 punch/$cm^2$. Within the above range, a sufficient entanglement is obtained and the damage of the sea-island long fibers by needles is minimized. By the entangling treatment, the sea-island long fibers are three-dimensionally entangled to obtain an entangled web of closely compacted sea-island long fibers, in which the sea-island long fibers exist in a density of 600 to 4000/$mm^2$ in average on a cross section parallel to the thickness direction. The long fiber web may be added with an oil agent at any stage from its production and the entangling treatment. The entangled long fiber web may be more densified by a shrinking treatment, for example, by immersing in a hot water at 70 to 150° C. In addition, the sea-island long fibers may be more compacted by a hot press so as to stabilize the shape of the long fiber web. However, the temperature for treatment should be selected so as not to dissipate the endothermic subpeak, because in the present invention the grain surface (fiber grain surface) is formed at low temperatures utilizing the endothermic subpeak of the island component polymer constituting the microfine long fibers, as described below. The mass per unit area of the entangled web is preferably 100 to 2000 $g/m^2$.

In Step 3, the microfine fiber bundle-forming long fibers (sea-island long fibers) are micro-fiberized by removing the sea component polymer to produce an entangled nonwoven fabric composed of bundles of microfine long fibers. In the present invention, the sea component polymer is preferably removed by treating the entangled web with a treating agent which is a non-solvent or non-decomposer for the island component polymer, but a solvent or decomposer for the sea component polymer. If the island component polymer is a polyamide resin or a polyester resin, an organic solvent such as toluene, trichloroethylene and tetrachloroethylene is used when the sea component polymer is polyethylene, a hot water is used when the sea component polymer is the water-soluble PVA, or an alkaline decomposer such as an aqueous solution of sodium hydroxide is used when the sea component polymer is an easily alkali-decomposable modified polyester. The removal of the sea component polymer is performed by a method generally used in the field of artificial leather and not particularly limited. In the present invention, the water-soluble PVA is preferably used as the sea component polymer because it is environmentally friend and good for worker's health. The water-soluble PVA is removed without using an organic solvent, for example, by treating with a hot water at 85 to 100° C. for 100 to 600 s until 95% by mass or more (inclusive of 100%) of the water-soluble PVA is removed by extraction, thereby converting the microfine fiber bundle-forming long fibers to the bundles of microfine long fibers made of the island component polymer.

If necessary, a shrinking treatment for densification may be performed before or simultaneously with the micro-fiberization of the microfine fiber bundle-forming long fibers until the areal shrinkage represented by the following formula:

$$[(\text{area before shrinking treatment} - \text{area after shrinking treatment})/\text{area before shrinking treatment}] \times 100$$

reaches preferably 30% or more and more preferably 30 to 75%. By the shrinking treatment, the shape retention is improved and the fiber pull-out is prevented.

When conducting before the micro-fiberization, the entangled web is shrunk preferably in steam atmosphere. The shrinking treatment by steam is preferably conducted, for example, by providing the entangled web with water in an amount of 30 to 200% by mass of the sea component, and then, heat-treating in a hot steam atmosphere at a relative humidity of 70% or more, preferably 90% or more and a temperature of 60 to 130° C. for 60 to 600 s. By the shrinking treatment under the above conditions, the sea component polymer plasticized by steam is compressed and deformed by the shrinking force of the long fibers made of the island component polymer, thereby facilitating the densification. After the shrinking treatment, the entangled web is treated in a hot water at 85 to 100° C., preferably 90 to 100° C. for 100 to 600 s to remove the sea component polymer by dissolution. To remove 95% by mass or more of the sea component polymer, a water jet extraction may be used. The temperature of water jet is preferably 80 to 98° C. The water jet speed is preferably 2 to 100 m/min. The treating time is preferably 1 to 20 min.

The shrinking treatment and the micro-fiberization are simultaneously conducted, for example, by immersing the entangled web in a hot water at 65 to 90° C. for 3 to 300 s and successively treating in a hot water at 85 to 100° C., preferably 90 to 100° C. for 100 to 600 s. In the former treatment, the microfine fiber bundle-forming long fibers shrink and simultaneously the sea component polymer is compressed. Part of the compressed sea component polymer is eluted from the fibers. Therefore, the voids to be formed by the removal of the sea component polymer are made finer, thereby obtaining an entangled nonwoven fabric more densified.

By the optional shrinking treatment and the removal of the sea component polymer, an entangled nonwoven fabric having a mass per unit area of preferably 140 to 3000 $g/m^2$ is obtained. The average fineness of the bundles in the entangled nonwoven fabric is 0.5 to 10 dtex, preferably 0.7 to 5 dtex. The average fineness of the microfine long fibers is 0.001 to 2 dtex, preferably 0.005 to 0.2 dtex. Within the above ranges, the leather-like sheet more densified is obtained and the nonwoven fabric structure of the surface portion is more densified. The number of microfine long fibers in each bundle is not particularly limited as long as the average fineness of the microfine long fibers and the average fineness of the bundles are within the above ranges, generally 5 to 1000 fibers in each bundle.

The wet peel strength of the entangled nonwoven fabric is preferably 4 kg/25 mm or more and more preferably 4 to 15 kg/25 mm. The peel strength is a measure of the degree of three-dimensional entanglement of the bundles of microfine long fibers. Within the above ranges, the surface abrasion of the entangled nonwoven fabric and the grain-finished leather-like sheet to be obtained is small and the shape is well retained. In addition, a grain-finished leather-like sheet with a good dense feel is obtained. As described below, the entangled nonwoven fabric may be dyed with a disperse dye before providing the elastic polymer. When the wet peel strength is within the above ranges, the pull-out and raveling of fibers during the dyeing operation are prevented.

Before Step 4 in which the entangled nonwoven fabric is provided with the aqueous dispersion or solution of the elastic polymer, the entangled nonwoven fabric may be dyed with a disperse dye, if necessary. Since the dyeing with a disperse dye is conducted under severe conditions (high temperature and high pressure), the microfine fibers may be broken when dyed before providing the elastic polymer (forward dyeing). In the present invention, however, the forward dyeing is applicable because the microfine fibers are long fibers. By the shrinking treatment mentioned above, the microfine long fibers shrink drastically to obtain the strength well withstanding the dyeing condition with disperse dye. Therefore, it is recommended to conduct the shrinking treatment before the forward dyeing. When the entangled nonwoven fabric containing the elastic polymer is dyed, a reductive washing step under a strong alkaline condition and a neutralizing step are generally required to remove the disperse dye adhered to the elastic polymer so as to improve the color fastness. In the present invention, since the dyeing can be conducted before Step 4 for proving the elastic polymer, these steps can be omitted. The known production method involves the problem that the elastic polymer falls off during the dyeing operation. In the present invention, however, this problem is avoided by the forward dyeing, and therefore, the elastic polymer can be selected from a wide range. After the forward dyeing, the excess dye is removed by washing with a hot water or a solution of neutral detergent. Therefore, the color fastness to rubbing, particularly the wet color fastness to rubbing is improved under extremely mild conditions. In addition, since the elastic polymer is not dyed, the color unevenness attributable to the difference in the color exhaustion between fibers and elastic polymer is prevented.

The disperse dyes having a molecular weight of 200 to 800 which are widely used for dyeing polyester are preferably used in the present invention. Examples thereof include monoazo dyes, disazo dyes, anthraquinone dyes, nitro dyes, naphthoquinone dyes, diphenylamine dyes, and hetero ring dyes. These dyes may be used alone or in combination according to application and intended color. The dyeing concentration varies depending upon the intended color. If dyed in a high concentration exceeding 30% owf, the wet color fastness to rubbing is reduced. Therefore, the dyeing concentration of 30% owf or less is preferred. The bath ratio is not critical and preferably 1:30 or less in view of production costs and environmental protection. The dyeing temperature is preferably 70 to 130° C. and more preferably 95 to 120° C. The dyeing time is preferably 30 to 90 min, and more preferably 30 to 60 min for light color dyeing and 45 to 90 min for deep color dyeing. When dyed in a dyeing concentration of 10% owf or more, the reductive washing may be conducted by using a washing liquid containing a reducing agent in a concentration as low as 3 g/L or less. However, the use of a warm water of 40 to 60° C. with a neutral detergent is preferred.

In Step 4, the entangled nonwoven fabric is provided with an aqueous dispersion or solution of the elastic polymer. The elastic polymer is allowed to migrate into the top surface and the back surface under heating and then coagulated to produce a leather-like sheet. At least one elastomer selected from those conventionally used in the production of artificial leathers is usable as the elastic polymer. Examples thereof include polyurethane elastomer, polyacrylonitrile elastomer, polyolefin elastomer, polyester elastomer, and poly(meth)acrylic elastomer, with polyurethane elastomer and/or poly(meth) acrylic elastomer being particularly preferred.

Known thermoplastic polyurethane is preferably used as the polyurethane elastomer, which is produced by the melt polymerization, bulk polymerization or solution polymerization of a polymer polyol, an organic polyisocyanate and an optional chain extender in a desired ratio.

The polymer polyol is selected from known polymer polyols according to the final use and required properties. Examples thereof include polyether polyols and their copolymers such as polyethylene glycol, polypropylene glycol, polytetramethylene glycol, and poly(methyltetramethylene glycol); polyester polyols and their copolymers such as polybutylene adipate diol, polybutylene sebacate diol, polyhexamethylene adipate diol, poly(3-methyl-1,5-pentylene adipate) diol, poly(3-methyl-1,5-pentylene sebacate) diol, and polycaprolactone diol; polycarbonate polyols and their copolymers such as polyhexamethylene carbonate diol, poly (3-methyl-1,5-pentylene carbonate) diol, polypentamethylene carbonate diol, and polytetramethylene carbonate diol; and polyester carbonate polyols. These polymer polyols may be used alone or in combination of two or more. The average molecular weight of the polymer polyol is preferably 500 to 3000. The combined use of two or more polymer polyols is preferred because the durability of the resultant grain-finished leather-like sheets such as fastness to light, fastness to heat, resistance to NOx yellowing, resistance to sweat and resistance to hydrolysis are improved.

The organic diisocyanate is selected from known diisocyanates according to the final use and required properties. Examples thereof include an aliphatic or alicyclic diisocyanate having no aromatic ring (non-yellowing diisocyanate) such as hexamethylene diisocyanate, isophorone diisocyanate, norbornene diisocyanate, and 4,4'-dicyclohexylmethane diisocyanate; and an aromatic diisocyanate such as phenylene diisocyanate, 2,4-tolylene diisocyanate, 2,6-tolylene diisocyanate, 4,4'-diphenylmethanediisocyanate, and xylylene diisocyanate, with the non-yellowing diisocyanate being preferred because the yellowing by light and heat hardly occurs.

The chain extender is selected according to the final use and required properties from known low-molecular compounds having two active hydrogen atoms which are used as the chain extender in the production of urethane resins. Examples thereof include diamines such as hydrazine, ethylenediamine, propylenediamine, hexamethylenediamine, nonamethylenediamine, xylylenediamine, isophoronediamine, piperazine and its derivatives, dihydrazide of adipic acid, and dihydrazide of isophthalic acid; triamines such as diethylenetriamine; tetramines such as triethylenetetramine; diols such as ethylene glycol, propylene glycol, 1,4-butanediol, 1,6-hexanediol, 1,4-bis(β-hydroxyethoxy)benzene, and 1,4-cyclohexanediol; toriols such as trimethylolpropane; pentaols such as pentapentaerythritol; and amino alcohols such as aminoethyl alcohol and aminopropyl alcohol. These chain extenders may be used alone or in combination of two or more. Of the above, the combined use of two to four of hydrazine, piperazine, hexamethylenediamine, isophoronediamine and its derivatives, and triamine such as ethylenetriamine is preferred. Since hydrazine and its derivatives has a anti-oxidation effect, the use thereof enhances the durability. During the chain extending reaction, a monoamine such as ethylamine, propylamine and butylamine; a carboxyl group-containing amine compound such as 4-aminobutanoic acid and 6-aminohexanoic acid; or a monool such as methanol, ethanol, propanol and butanol may be combinedly used together with the chain extender.

The content of the soft segments (polymer diol) of the thermoplastic polyurethane is preferably 90 to 15% by mass.

Examples of the poly(meth)acrylic elastomer include polymers of a water-dispersible or water-soluble, ethylenically unsaturated monomer, which are composed of a soft component, a crosslinkable component, a hard component and another component which is distinguished from any of the preceding components.

The soft component is derived from a monomer which can form a homopolymer having a glass transition temperature (Tg) of less than −5° C., preferably −90° C. or more and less than −5° C., and is preferably non-crosslinkable (not forming crosslink). Examples of the monomer for constituting the soft component include (meth)acrylic acid derivatives such as ethyl acrylate, n-butyl acrylate, isobutyl acrylate, isopropyl acrylate, n-hexyl (meth)acrylate, 2-ethylhexyl (meth)acrylate, lauryl (meth)acrylate, stearyl (meth)acrylate, cyclohexyl acrylate, benzyl acrylate, 2-hydroxyethyl acrylate, and 2-hydroxypropyl acrylate. These monomers may be used alone or in combination of two or more.

The hard component is derived from a monomer which can form a homopolymer having a glass transition temperature (Tg) of higher than 50° C., preferably higher than 50° C. and 250° C. or less, and is preferably non-crosslinkable (not forming crosslink). Examples of the monomer for constituting the hard component include (meth)acrylic acid derivatives such as methyl methacrylate, ethyl methacrylate, isopropyl methacrylate, isobutyl methacrylate, cyclohexyl methacrylate, (meth)acrylic acid, dimethylaminoethyl methacrylate, diethylaminoethyl methacrylate, and 2-hydroxyethyl methacrylate; aromatic vinyl compounds such as styrene, α-methylstyrene, and p-methylstyrene; acrylamides such as (meth) acrylamide and diacetone (meth)acrylamide; maleic acid, fumaric acid, itaconic acid and their derivatives; heterocyclic vinyl compounds such as vinylpyrrolidone; vinyl compounds such as vinyl chloride, acrylonitrile, vinyl ether, vinyl ketone and vinylamide; and α-olefin such as ethylene and propylene. These monomers may be used alone or in combination of two or more.

The crosslinkable component is a mono- or multifunctional ethylenically unsaturated monomer unit capable of forming a crosslinked structure or a compound (crosslinking agent) capable of forming a crosslinked structure by the reaction with an ethylenically unsaturated monomer unit in a polymer chain. Examples of the mono- or multifunctional ethylenically unsaturated monomer include di(meth)acrylates such as ethylene glycol di(meth)acrylate, triethylene glycol di(meth)acrylate, polyethylene glycol di(meth)acrylate, 1,4-butanediol di(meth)acrylate, 1,6-hexanediol di(meth)acrylate, 1,9-nonanediol di(meth)acrylate, neopentyl glycol di(meth)acrylate, dimethylol tricyclodecane di(meth)acrylate, and glycerin di(meth)acrylate; tri(meth) acrylates such as trimethylol propane tri(meth)acrylate and pentaerythritol tri(meth)acrylate; tetra (meth)acrylates such as pentaerythritol tetra(meth)acrylate; multifunctional vinyl compounds such as divinylbenzene and trivinylbenzene; (meth)acrylic unsaturated esters such as allyl (meth)acrylate and vinyl (meth)acrylate; urethane acrylates having a molecular weight of 1500 or less such as 2:1 adduct of 2-hydroxy-3-phenoxypropyl acrylate and hexamethylene diisocyanate, 2:1 adduct of pentaerythritol triacrylate and hexamethylene diisocyanate, and 2:1 adduct of glycerin dimethacrylate and tolylene diisocyanate; (meth)acrylic acid derivative having hydroxyl group such as 2-hydroxyethyl (meth)acrylate and 2-hydroxypropyl (meth)acrylate; acrylamides such as (meth)acrylamide and diacetone(meth)acrylamide; derivatives thereof, (meth)acrylic acid derivative having epoxy group such as glycidyl (meth)acrylate; vinyl compounds having carboxyl group such as (meth)acrylic acid, maleic acid, fumaric acid and itaconic acid; and vinyl compounds having amide group such as vinylamide. These monomers may be used alone or in combination of two or more.

Examples of the crosslinking agent include oxazoline group-containing compounds, carbodiimide group-containing compounds, epoxy group-containing compounds, hydrazine derivatives, hydrazide derivatives, polyisocyanates, and multifunctional block isocyanates. These compounds may be used alone or in combination of two or more.

Examples of the monomer which constitutes other components of the (meth)acrylic elastic polymer include (meth) acrylic acid derivatives such as methyl acrylate, n-butyl methacrylate, hydroxypropyl methacrylate, glycidyl (meth) acrylate, dimethylaminoethyl methacrylate, and diethylaminoethyl methacrylate.

The melting point of the elastic polymer is preferably 130 to 240° C. The hot-water swelling at 130° C. is 10% or more, preferably 10 to 100%. Generally, the elastic polymer becomes softer with increasing hot-water swelling, but the intermolecular cohesion becomes weak. Therefore, the elastic polymer falls off in the subsequent production processes or during the use of products, thereby failing to serve as a binder. Within the above range, these drawbacks are avoided. The hot-water swelling is measured by the method described below.

The elastic polymer is impregnated into the entangled nonwoven fabric in the form of an aqueous solution or dispersion. The content of the elastic polymer in the aqueous solution or dispersion is preferably 0.1 to 60% by mass. The aqueous solution or dispersion of the elastic polymer is impregnated in an amount such that the ratio by mass of the elastic polymer after coagulated and the microfine long fibers is 0.001 to 0.6, preferably 0.005 to 0.6, and more preferably 0.01 to 0.5. The aqueous solution or dispersion of the elastic polymer may be added with penetrant, defoaming agent, lubricant, water repellent, oil repellent, thickener, bulking agent, curing promoter, antioxidant, ultraviolet absorber, fluorescent agent, antimold agent, foaming agent, water-soluble polymer such as polyvinyl alcohol and carboxymethylcellulose, dye, pigment, etc. as long as the properties of resultant grain-finished leather-like sheet are not adversely affected.

The aqueous solution or dispersion of the elastic polymer is impregnated into the entangled nonwoven fabric, for example, by dipping to distribute the elastic polymer uniformly inside the entangled nonwoven fabric or by applying on the top and back surfaces, although not particularly limited thereto. In the known production of artificial leathers, the impregnated elastic polymer is prevented from migrating toward the top and back surfaces of the entangled nonwoven fabric by using a heat-sensitive gelling agent, etc., thereby distributing the coagulated elastic polymer uniformly in the entangled nonwoven fabric. In the present invention, however, the impregnated elastic polymer is preferably allowed to migrate into the top and back surfaces of the entangled nonwoven fabric and then coagulated, thereby allowing the elastic polymer to be distributed with a nearly continuous gradient along the thickness direction. Namely, in the (semi)grain-finished leather-like sheet of invention it is preferred that the elastic polymer exists sparsely in the central portion in the thickness direction and exists thickly in both the surface portions. To obtain such a distribution gradient, in the present invention the top and back surfaces of the entangled nonwoven fabric impregnated with the aqueous solution or dispersion of the elastic polymer is, without preventing the migration, heated preferably at 110 to 150° C. and preferably for 0.5 to 30 min. By such a heating, water transpires from the top and back surfaces to allow the water containing the elastic polymer to migrate toward both the surfaces, and then, the elastic polymer is coagulated in the vicinity of the top and back surfaces. The heating for migration is preferably conducted in a drier by blowing a hot air onto the top and back surfaces.

In Step 5, the top and back surfaces of the leather-like sheet obtained in Step 4 (entangled nonwoven fabric containing the coagulated elastic polymer) are hot-pressed at a temperature which is 50° C. or more lower that the spinning temperature of the sea-island long fibers and equal to or less than the melting point of the elastic polymer. By this hot press, the grain surface is formed. The heating temperature is preferably 130° C. or more, although not particularly limited thereto as long as the grain surface is formed. The hot press is conducted, for example, by a heated metal roll preferably under a line pressure of 1 to 1000 N/mm. If the hot-press temperature is higher than the temperature which is 50° C. lower than the spinning temperature of the sea-island long fibers, the polymer constituting the microfine long fibers becomes highly fuse-bonding. Therefore, the microfine long fibers in the inner portion underlying the surface layers, for example, the microfine long fibers in the substrate layer 2 (described below) are fuse-bonded to each other, to make the leather-like sheet very hard like a plate. If the hot press temperature is higher than the melting point of the elastic polymer, the elastic polymer is melted to adhere to the press machine. Therefore, a smooth grain surface is not obtained and the productivity is lowered.

As described above, the method of forming the grain surface of the invention is different from a method in which the elastic polymer is applied onto the surface of the entangled nonwoven fabric impregnated with the elastic polymer and then coagulated or a method in which a film of the elastic polymer is laminated onto the surface. Namely, in the present invention the aqueous solution or dispersion of the elastic polymer is impregnated into the entangled nonwoven fabric; the impregnated elastic polymer is migrated toward the top and back surfaces and then coagulated, thereby distributing the elastic polymer in the vicinity of the top and back surfaces more thickly than in the central portion; and then the top and back surfaces are hot-pressed to form the grain surface. With this method, the grain surface can be formed at relatively lower temperatures. This may be because of a partial fuse-bonding of the microfine fibers attributable to the endothermic subpeak of the microfine long fibers. The grain surface formed by the application or lamination method is highly plastic and rubbery and poor in bulky feeling. In contrast, the grain surface obtained by the method of the invention has an appearance resembling natural leathers, a low compression resistance, and dense feel. The thickness of the grain-finished leather-like sheet thus obtained is preferably 100 μm to 6 mm.

When the (semi)grain-finished leather-like sheet is divided into five equal layers, i.e., surface layer/substrate layer 1/substrate layer 2/substrate layer 3/back layer, in this order along the thickness direction (see FIG. 1), the contents (based on mass) of the elastic polymer in the layers are preferably 20 to 60%/2 to 30%/0 to 20%/2 to 30%/20 to 60% and more preferably 25 to 50%/2 to 28%/0 to 13%/2 to 28%/25 to 50%, while setting a total content of five layers 100% by mass. The content of each of the surface layer and the back layer is larger that that of each of the substrate layer 1, the substrate layer 2 and the substrate layer 3. For example, the content of each of the surface layer and the back layer is preferably at least 1.2 times the content of each of the substrate layer 1 and the substrate layer 3, and preferably at least 1.5 times the content of the substrate layer 2.

Figure 4:
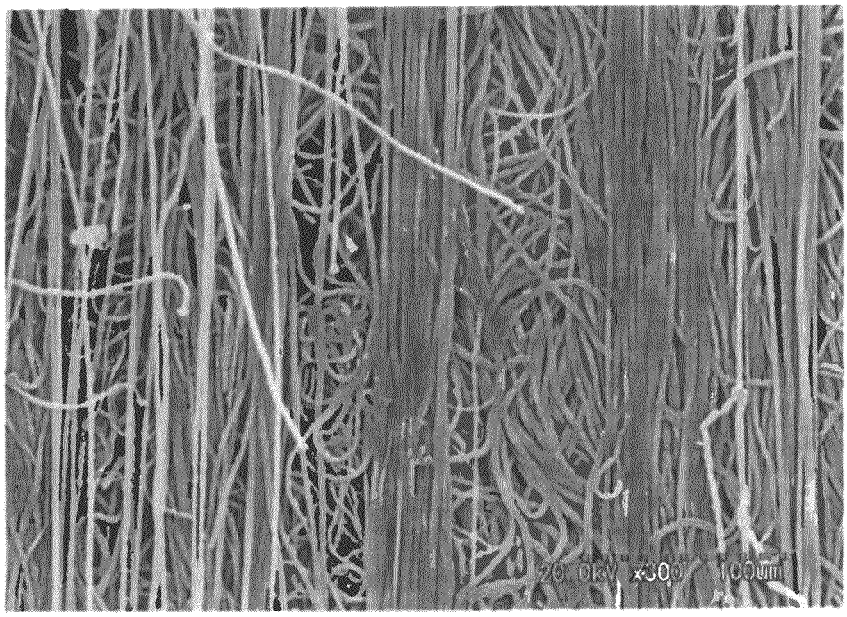
FIG. 4 is a scanning electron microphotograph (×300) showing the fuse-bonding between microfine long fibers in the surface layer or the back layer of the grain-finished leather-like sheet of the invention.
Figure 5:
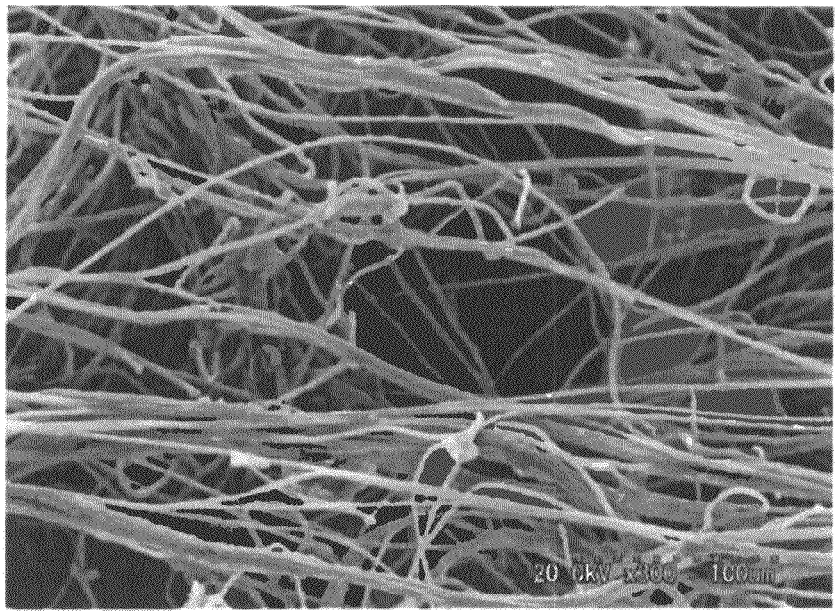
FIG. 5 is a scanning electron microphotograph (×300) showing the fuse-bonding between microfine long fibers in the surface layer or the back layer after rubbing the grain-finished leather-like sheet of FIG. 4 with hand.
Figure 6:
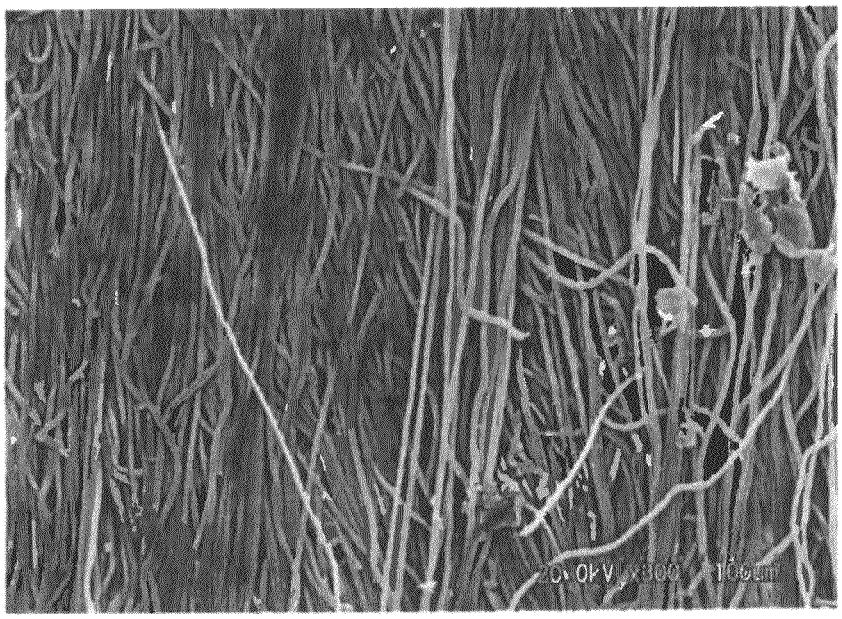
FIG. 6 is a scanning electron microphotograph (×300) showing the fuse-bonding between microfine long fibers in the surface layer or the back layer of another grain-finished leather-like sheet of the invention.

As shown in FIGS. 4 and 6, the microfine long fibers which constitute the surface and back layers of the (semi)grain-finished leather-like sheet produced by the above method are at least partly fuse-bonded to each other by the hot press of Step 5. The (semi)grain-finished leather-like sheet was produced without providing the elastic polymer for easy observation of the fuse-bonding state. FIG. 5 is a scanning electron microphotograph taken after rubbing the (semi)grain-finished leather-like sheet with hand to separate or open the bundled microfine long fibers apart. It can be seen that the microfine long fibers are surely fuse-bonded to each other. Thus, in the present invention the grain surface is formed by the fuse-bonded microfine long fibers and the elastic polymer retains the shape thereof. In contrast, the microfine long fibers constituting the substrate layer 2 are not fuse-bonded. In the present invention, the term "partly fuse-bonded" means that the microfine long fibers are fuse-bonded to each other partly along the lengthwise direction as shown in FIGS. 4 and 6 and that part of microfine long fibers in a cross section of a fiber bundle are fuse-bonded to each other as shown in FIG. 2.

Figure 2:
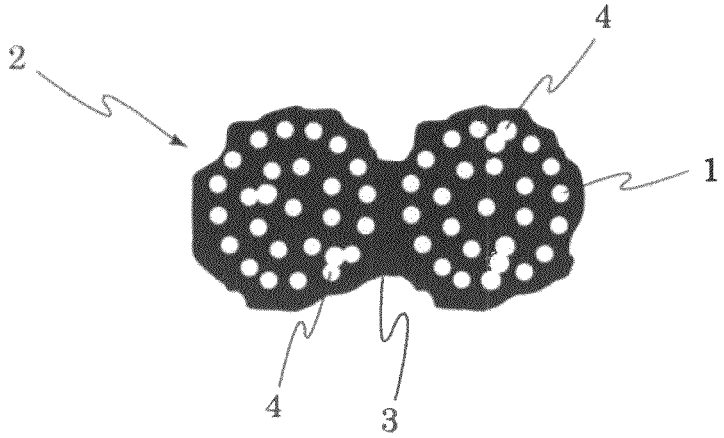
FIG. 2 is a schematic illustration showing the bondings between the bundles and the elastic polymer in the surface layer or the back layer of the grain-finished leather-like sheet of the invention.
Figure 3:
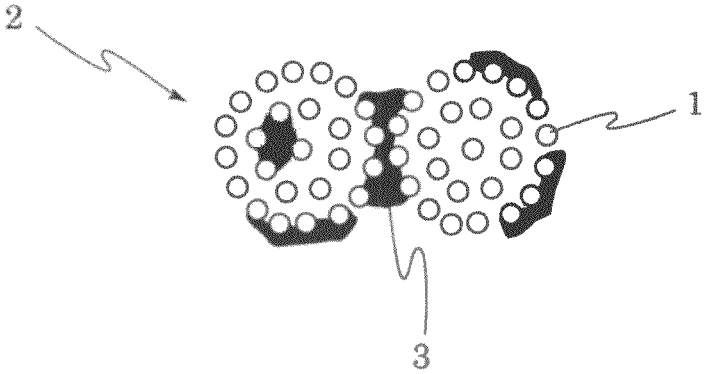
FIG. 3 is a schematic illustration showing the bondings between the bundles and the elastic polymer in the substrate layer 2 of the grain-finished leather-like sheet of the invention.

As shown in FIG. 2, the inside of the fiber bundle 2 in the surface and back layers is filled up with the elastic polymer 3 and the outer surface of the fiber bundle 2 is completely covered with the elastic polymer 3. Part of the microfine fibers are fuse-bonded (reference numeral 4). As shown in FIG. 3, if the substrate layer 2 contains the elastic polymer, the microfine long fibers 1, the fiber bundles 2, and the microfine long fibers 1 and the fiber bundle 2 are bonded to each other via the elastic polymer 3. However, the inside of the fiber bundle 2 is not filled up with the elastic polymer 3, and the outer surface of the fiber bundle 2 is not completely covered with the elastic polymer 3 but only part thereof is covered.

The grain-finished leather-like sheet of the invention combines a low compression resistance and a dense feel each comparable to natural leathers, forms fine bent wrinkles resembling natural leathers, and has a sufficient practical strength, and therefore, suitably used in wide applications such as clothes, shoes, bags, furniture, car seats, gloves, brief cases, and curtains.

The aesthetically appealing grain-finished leather-like sheet, the grain-finished leather-like sheet with reduced damp and hot feeling under wearing, the grain-finished leather-like sheet with good wet grippability, the grain-finished leather-like sheet providing high-strength strings, and the antique-looking semigrain-finished leather-like sheet which are suitable for the above applications will be described below.

(A) Aesthetically Appealing Grain-finished Leather-like Sheet

The aesthetically appealing grain-finished leather-like sheet is obtained by using the (meth)acrylic elastic polymer (hot-water swelling at 130° C.: 10% or more, peak temperature of loss elastic modulus: 10° C. or less, tensile strength at 100% elongation: 2 N/cm$^2$ or less, elongation at tensile break: 100% or more) as the elastic polymer. By using the (meth) acrylic elastic polymer, the resultant grain-finished leather-like sheet exhibits a pull-up property, a dense feel and a soft feel each resembling natural leathers without using a low-melting point wax.

The aesthetically appealing grain-finished leather-like sheet of the invention is composed of an entangled nonwoven fabric comprising three-dimensionally entangled fiber bundles containing microfine long fibers and the (meth) acrylic elastic polymer contained in the entangled nonwoven fabric, and simultaneously satisfies the following requirements 1 to 4:

(1) an average fineness of the microfine long fibers is 0.001 to 2 dtex;

(2) an average fineness of the fiber bundles of the microfine long fibers is 0.5 to 10 dtex;

(3) at least part of the microfine long fibers which form a surface layer and a back layer are fuse-bonded to each other, and the microfine long fibers which form a substrate layer 2 are not fuse-bonded, when the grain-finished leather-like sheet is divided to five layers with equal thickness (from one surface to the other), surface layer, substrate layer 1, substrate layer 2, substrate layer 3 and back layer, in this order along a thickness direction thereof, and (4) the (meth)acrylic elastic polymer has a hot-water swelling at 130° C. of 10% or more, a peak temperature of loss elastic modulus of 10° C. or less, a tensile strength at 100% elongation of 2 N/cm$^2$ or less, and an elongation at tensile break of 100% or more.

A (meth)acrylic elastic polymer wherein the content of the soft component is 80 to 98% by mass, the content of the crosslinkable component is 1 to 20% by mass, the content of the hard component is 0 to 19% by mass, and the content of other component is 0 to 19% by mass is preferably used. Particularly preferred is a (meth)acrylic elastic polymer wherein the content of the soft component is 85 to 96% by mass, the content of the crosslinkable component is 1 to 10% by mass, and the content of the hard component is 3 to 15% by mass.

The melting point of the elastic polymer is preferably 130 to 240° C. and the hot-water swelling at 130° C. is 10% or more, preferably 10 to 100%. Generally, the elastic polymer becomes softer with increasing hot-water swelling, but the intermolecular cohesion becomes low. Therefore, the elastic polymer falls off in the subsequent production processes or during the use of products, thereby failing to serve as a binder. Within the above range, these drawbacks are avoided. The hot-water swelling is measured by the method described below.

The peak temperature of loss elastic modulus of the elastic polymer is 10° C. or less, preferably −80 to 10° C. If exceeding 10° C., the hand of the grain-finished leather-like sheet becomes hard and the mechanical durability such as the resistance to flexing is deteriorated. The loss elastic modulus is measured by the method described below.

The tensile strength at 100% elongation of the (meth) acrylic elastic polymer is 2 N/cm$^2$ or less, preferably 0.05 to 2 N/cm$^2$. Within the above range, the grain-finished leather-like sheet has a soft hand and a good pull-up property, and the surface is prevented from being sticky or tacky during the use. The tensile strength at 100% elongation is measured by the method described below.

The elongation at tensile break of the (meth)acrylic elastic polymer is 100% or more, preferably 100 to 1500%. Within the above range, since the surface layer does not contain a brittle solid polymer, the pull-up property does not change in a long term use, thereby improving the durability. The elongation at tensile break is measured by the method described below.

The aesthetically appealing grain-finished leather-like sheet is produced by the following sequential steps:

(1a) a step of producing a long fiber web comprising microfine fiber bundle-forming long fibers by using sea-island long fibers;

(2a) a step of producing an entangled web by entangling the long fiber web;

(3a) a step of producing an entangled nonwoven fabric by removing a sea component from the microfine fiber bundle-forming long fibers in the entangled web, thereby converting the microfine fiber bundle-forming long fibers to bundles having an average single fiber fineness of 0.5 to 10 dtex and containing microfine long fibers having an average fineness of 0.001 to 2 dtex;

(4a) a step of providing the entangled nonwoven fabric with an aqueous dispersion or solution of a (meth)acrylic elastic polymer in an elastic polymer/microfine long fiber mass ratio of 0.005 to 0.6, and allowing the (meth)acrylic elastic polymer to migrate to both surfaces (top and back surfaces) of the entangled nonwoven fabric and coagulate under heating, thereby obtaining a leather-like sheet; and (5a) a step of forming a grain surface by hot pressing both surfaces of the leather-like sheet at a temperature which is 50° C. or more lower than a spinning temperature of the sea-island long fibers and equal to or less than a melting point of the (meth)acrylic elastic polymer.

The entangling treatment of Step 2a is conducted preferably by a needle punching in a punching density of 300 to 4800 punch/cm$^2$. The shrinking treatment before the microfiberization, if employed, is preferably conducted by providing the entangled web with water in an amount of 70 to 200% by mass of the sea component, and then, heat-treating the water-containing entangled web in a heated steam atmosphere at a relative humidity of 70% or more, preferably 90% or more and 60 to 130° C. for 60 to 600 s.

The other features of the aesthetically appealing grain-finished leather-like sheet and its production method are as described above.

(B) Grain-finished Leather-like Sheet with Reduced Damp and Hot Feeling Under Wearing The grain-finished leather-like sheet with reduced damp and hot feeling under wearing of the invention is composed of an entangled nonwoven fabric comprising three-dimensionally entangled fiber bundles containing microfine long fibers and an elastic polymer contained in the entangled nonwoven fabric, and simultaneously satisfies the following requirements 1 to 5:

(1) an average fineness of the microfine long fibers is 0.001 to 0.5 dtex;

(2) an average fineness of the fiber bundles of the microfine long fibers is 0.5 to 4 dtex;

(3) at least part of the microfine long fibers which form a surface layer and a back layer are fuse-bonded to each other, and the microfine long fibers which form a substrate layer 2 are not fuse-bonded, when the grain-finished leather-like sheet is divided to five layers with equal thickness, surface layer, substrate layer 1, substrate layer 2, substrate layer 3 and back layer, in this order along a thickness direction thereof.

(4) fine voids surrounded by the microfine fibers having a maximum width of 0.1 to 50 μm and a minimum width of 10 μm or less exist 8000 or more per 1 cm$^2$ of surface, and (5) a surface abrasion loss is 30 mg or less when measured by Martindale method under a load of 12 kPa (gf/cm$^2$) at 50,000 times of abrasions.

The average fineness of the fiber bundles in the entangled nonwoven fabric which forms the grain-finished leather-like sheet with reduced damp and hot feeling under wearing is 0.5 to 4 dtex, preferably 0.7 to 3 dtex. The average fineness of the microfine long fibers is 0.001 to 0.5 dtex, preferably 0.002 to 0.15 dtex. Within the above ranges, the resultant leather-like sheet and the nonwoven fabric structure in the surface layer are more densified.

In the grain-finished leather-like sheet with reduced damp and hot feeling under wearing, the fine voids surrounded by the microfine fibers having a maximum width of 0.1 to 50 μm and a minimum width of 10 μm or less exist in a density of 8000 or more per 1 cm$^2$ of surface. If the sizes of the fine voids are larger than the above ranges, the roughness on the surface becomes noticeable to deteriorate the surface appearance. By meeting the above requirements, an air permeability of 0.2 cc/cm$^2$/s or more and a moisture permeability of 1000 g/m$^2$·24 h or more at 30° C. and 80% RH are obtained. The existing density of the fine voids is preferably 8000 to 100000. If less than 8000, a sufficient air permeability and moisture permeability are not obtained. The size and the number of fine voids are measured under an electron microscope.

To form the fine voids surrounded by the microfine fibers having a maximum width of 0.1 to 50 μm and a minimum width of 10 μm or less in a density of 8000 or more per 1 cm$^2$ of surface, the number of islands of the sea-island long fibers is preferably 12 to 1000.

The surface abrasion loss is 30 mg or less when measured by Martindale method under a load of 12 kPa at 50,000 times of abrasions. If exceeding 30 mg, the surface abrasion loss during use is large and the appearance largely changes, thereby reducing the durability.

The grain-finished leather-like sheet with reduced damp and hot feeling under wearing of the invention is produced by the following sequential steps:

(1b) a step of producing a long fiber web comprising microfine fiber bundle-forming long fibers by using sea-island long fibers;

(2b) a step of producing an entangled web by entangling the long fiber web;

(3b) a step of producing an entangled nonwoven fabric by removing a sea component from the microfine fiber bundle-forming long fibers in the entangled web, thereby converting the microfine fiber bundle-forming long fibers to bundles having an average single fiber fineness of 0.5 to 10 dtex and containing microfine long fibers having an average fineness of 0.001 to 2 dtex;

(4b) a step of providing the entangled nonwoven fabric with an aqueous dispersion or solution of an elastic polymer in an elastic polymer/microfine long fiber mass ratio of 0.001 to 0.6, and allowing the elastic polymer to migrate to both surfaces of the entangled nonwoven fabric and coagulate under heating, thereby obtaining a leather-like sheet; and (5b) a step of forming a grain surface by hot pressing both surfaces of the leather-like sheet at a temperature which is 50° C. or more lower than a spinning temperature of the sea-island long fibers and equal to or less than a melting point of the elastic polymer.

The shrinking treatment before or during the conversion of the microfine fiber bundle-forming long fibers to microfine fibers, if employed, is conducted such that the areal shrinkage is preferably 40% or more, more preferably 40 to 75%. If being 40% or more, a desired number of fine voids are easily formed. In addition, by the shrinking treatment, the shape retention is improved and the fiber pull-out is prevented.

The grain-finished leather-like sheet with reduced damp and hot feeling under wearing of the invention combines a low compression resistance and a dense feel each comparable to natural leathers, forms fine bent wrinkles resembling natural leathers and has a sufficient practical strength. Since the air permeability is 0.2 cc/cm$^2$/s or more and the moisture permeability (at 30° C. and 80% RH) is 1000 g/m$^2$·24 h or more, the artificial leather products at least partially made of the grain-finished leather-like sheet is reduced in the damp and hot feeling. Such artificial leather products include clothes, shoes, bags, furniture, car seat, gloves, briefcases, and curtains. The grain-finished leather-like sheet is preferably applied to the products such as shoes and gloves which are worn in contact with human skin and particularly required to be reduced in damp and hot feeling.

The other features of the grain-finished leather-like sheet with reduced damp and hot feeling under wearing and its production method are as described above.

(C) Grain-finished Leather-like Sheet with Good Wet Grippability

The grain-finished leather-like sheet with good wet grippability of the invention is composed of an entangled nonwoven fabric comprising three-dimensionally entangled fiber bundles containing microfine long fibers and an elastic polymer contained in the entangled nonwoven fabric, and simultaneously satisfies the following requirements 1 to 4:

(1) an average fineness of the microfine long fibers is 0.005 to 2 dtex;

(2) an average fineness of the fiber bundles of the microfine long fibers is 1.0 to 10 dtex;

(3) at least part of the microfine long fibers which form a surface layer and a back layer are fuse-bonded to each other, and the microfine long fibers which form a substrate layer 2 are not fuse-bonded, when the grain-finished leather-like sheet is divided to five layers with equal thickness, surface layer, substrate layer 1, substrate layer 2, substrate layer 3 and back layer, in this order along a thickness direction thereof; and (4) a static coefficient of friction and a dynamic coefficient of friction of a surface of the grain-finished leather-like sheet satisfy the following formulae I and $$\text{static coefficient of friction(wet)} \geq \text{static coefficient of friction(dry)} \quad \text{(I)}$$

$$\text{dynamic coefficient of friction(wet)} \geq \text{dynamic coefficient of friction(dry)} \quad \text{(II).}$$

Meeting the above requirements, particularly, the requirement 4, the grain-finished leather-like sheet exhibits an excellent handling ability comparable to that in dry condition even when the surface is wet with sweat, rain and other watery component.

The average fineness of the fiber bundles in the entangled nonwoven fabric is 1.0 to 10 dtex, preferably 1.0 to 6.0 dtex. The average fineness of the microfine long fibers is 0.005 to 2 dtex, preferably 0.01 to 0.5 dtex. Within the above ranges, the resultant leather-like sheet and the nonwoven fabric structure in the surface layer are more densified.

The grain-finished leather-like sheet with good wet grippability is produced by the following sequential steps:

(1c) a step of producing a long fiber web comprising microfine fiber bundle-forming long fibers by using sea-island long fibers;

(2c) a step of producing an entangled web by entangling the long fiber web;

(3c) a step of producing an entangled nonwoven fabric by removing a sea component from the microfine fiber bundle-forming long fibers in the entangled web, thereby converting the microfine fiber bundle-forming long fibers to bundles having an average single fiber fineness of 1.0 to 10 dtex and containing microfine long fibers having an average fineness of 0.005 to 2 dtex;

(4c) a step of providing the entangled nonwoven fabric with an aqueous dispersion or solution of an elastic polymer in an elastic polymer/microfine long fiber mass ratio of 0.001 to 0.3, and allowing the elastic polymer to migrate to both surfaces (top and back surfaces) of the entangled nonwoven fabric and coagulate under heating, thereby obtaining a leather-like sheet; and (5c) a step of forming a grain surface by hot pressing both surfaces of the leather-like sheet at a temperature which is 50° C. or more lower than a spinning temperature of the sea-island long fibers and equal to or less than a melting point of the elastic polymer.

The melting point of the elastic polymer used in Step 4c is preferably 130 to 240° C., and the hot-water swelling at 130° C. is 40% or more, preferably 40 to 80%. Generally, the elastic polymer becomes softer with increasing hot-water swelling, but the intermolecular cohesion becomes low. Therefore, the elastic polymer falls off in the subsequent production processes or during the use of products, thereby failing to serve as a binder. Within the above range, these drawbacks are avoided. In addition, the water absorbability is good.

The elastic polymer is selected from those mentioned above and the water-dispersible (meth)acrylic elastic polymer mentioned above is particularly preferred, because it is hydrophobic, easily absorbs water and easily exhales or transpires the absorbed water.

In Step 4c, the impregnated amount of the aqueous solution or dispersion of the elastic polymer is 0.001 to 0.3, preferably 0.005 to 0.20 when expressed by a ratio by mass of the coagulated elastic polymer and the microfine long fibers. Within the above range, a grain-finished leather-like sheet surface which is rich in the microfine long fibers but contains a relatively small amount of the elastic polymer is obtained, to allow the absorbed water to easily diffuse to inside.

The grain-finished leather-like sheet having the above structure satisfies the following formulae (I) and (II):

$$\text{static coefficient of friction(wet)} \geq \text{static coefficient of friction(dry)} \quad \text{(I)}$$

$$\text{dynamic coefficient of friction(wet)} \geq \text{dynamic coefficient of friction(dry)} \quad \text{(II).}$$

Namely, the static coefficient of friction in wet condition and the dynamic coefficient of friction in wet condition are equal to or higher than those in dry condition, respectively. Therefore, the grippability is better in wet condition than in dry condition. "Wet condition" and "dry condition" for measuring the static coefficient of friction and the dynamic coefficient of friction will be defined below.

The difference between the static coefficient of friction (wet) and the static coefficient of friction (dry) is preferably 0 to 0.2. The difference between the dynamic coefficient of friction (wet) and the dynamic coefficient of friction (dry) is preferably 0 to 0.3. If each difference is within the above range, products made from the grain-finished leather-like sheet such as game balls exhibit a grippability equal to that in dry condition even when the surface is wet with sweat, etc. Therefore, the grippability is not remarkably changed by wetting during play, and players are devoted to play without feeling the change of handling ability.

The other features of the grain-finished leather-like sheet with good wet grippability and its production method are as described above.

The grain-finished leather-like sheet with good wet grippability of the invention is suitable as the materials for grips of golf club and tennis racket, game balls which are handled with bare hands such as basketball, American football, handball and rugby ball, and heal and sole of shoes. The grain-finished leather-like sheet is made into grips, game balls, heal and sole by a known method without any particular limitation. For example, the game balls are produced by a method including a step of forming a pebble and valley pattern which is suitable for each game ball or conventionally employed in the production thereof on the surface of the grain-finished leather-like sheet.

(D) Grain-finished Leather-like Sheet Providing High-strength Strings

The grain-finished leather-like sheet providing high-strength strings is composed of an entangled nonwoven fabric comprising three-dimensionally entangled fiber bundles containing microfine long fibers and an elastic polymer contained in the entangled nonwoven fabric, and simultaneously satisfies the following requirements 1 to 5:

(1) an average fineness of the microfine long fibers is 0.005 to 2 dtex;

(2) an average fineness of the fiber bundles of the microfine long fibers is 0.5 to 10 dtex; and (3) at least part of the microfine long fibers which form a surface layer are fuse-bonded to each other, and the microfine long fibers which form a substrate layer 2 are not fuse-bonded, when the grain-finished leather-like sheet is divided to five layers with equal thickness, surface layer, substrate layer 1, substrate layer 2, substrate layer 3 and back layer, in this order along a thickness direction thereof;

(4) an apparent density of the grain-finished leather-like sheet is 0.5 g/cm$^3$ or more; and (5) a string of the grain-finished leather-like sheet having a width of 5 mm, which is obtained by cutting the grain-finished leather-like sheet along a machine direction (MD) or a crossing direction (CD), has a breaking strength of 1.5 kg/mm$^2$ or more (20 kg or more).

The average fineness of the fiber bundles in the entangled nonwoven fabric constituting the grain-finished leather-like sheet providing high-strength strings is 0.5 to 10 dtex, preferably 1.0 to 6 dtex. The average fineness of the microfine long fibers is 0.005 to 2 dtex, preferably 0.05 to 1 dtex. Within the above ranges, the resultant leather-like sheet and the nonwoven fabric structure in the surface layer are more densified.

The grain-finished leather-like sheet providing high-strength strings of the invention is produced by the following sequential steps:

(1d) a step of producing a long fiber web comprising microfine fiber bundle-forming long fibers by using sea-island long fibers;

(2d) a step of producing an entangled web by entangling the long fiber web;

(3d) a step of producing an entangled nonwoven fabric by removing a sea component from the microfine fiber bundle-forming long fibers in the entangled web, thereby converting the microfine fiber bundle-forming long fibers to bundles having an average single fiber fineness of 0.5 to 10 dtex and containing microfine long fibers having an average fineness of 0.005 to 2 dtex;

(4d) a step of providing the entangled nonwoven fabric with an aqueous dispersion of an elastic polymer in an elastic polymer/microfine long fiber mass ratio of 0.001 to 0.6, and allowing the elastic polymer to migrate to both surfaces (top and back surfaces) of the entangled nonwoven fabric and coagulate under heating, thereby obtaining a leather-like sheet; and (5d) a step of forming a grain surface by hot pressing both surfaces of the leather-like sheet at a temperature which is 50° C. or more lower than a spinning temperature of the sea-island long fibers and equal to or less than a melting point of the elastic polymer.

The shrinking treatment before or during the conversion of the microfine fiber bundle-forming long fibers to microfine fibers, if employed, is conducted such that the areal shrinkage is preferably 20% or more, more preferably 25 to 60%. By the shrinking treatment, the shape retention is improved and the fiber pull-out is prevented.

The shrinking treatment and microfiberization may be performed under tension in a machine direction such that a ratio (CD/MD) of the shrinkage in a crossing direction (CD) and the shrinkage in a machine direction (MD) is 1.4 to 6.0. In the known production of leather-like sheets, the shrinking is usually made isotropically without tension. However, in a preferred embodiment of the invention, the shrinking is made anisotropically as described above. Artificial leather strings produced by cutting the grain-finished leather-like sheet thus obtained along its machine direction (MD) into strings have a sufficient strength comparable to that of natural leathers without drawing before use. Therefore, the deterioration of the surface property by drawing is avoided and the productivity is improved because the drawing process is omitted.

In Step 4d, the impregnated amount of the aqueous solution or dispersion of the elastic polymer is 0.001 to 0.6, preferably 0.01 to 0.45 when expressed by a ratio by mass of the coagulated elastic polymer and the microfine long fibers.

The apparent density of the grain-finished leather-like sheet thus obtained is 0.5 g/cm$^3$ or more, preferably 0.5 to 0.90 g/cm$^3$. If being 0.5 g/cm$^3$ or more, a high strength is obtained. In view of the processability after cutting, difficulty of unknotting and prevention of nicks in cutter, the apparent density is preferably 0.85 g/cm$^3$ or less.

The other features of the grain-finished leather-like sheet providing high-strength strings and its production method are as described above.

The artificial leather strings of the invention are produced by cutting the grain-finished leather-like sheet into strings which have a width of 2 to 10 mm along the crossing direction (CD) or the machine direction (MD). The cutting is performed by a known method conventionally employed in cutting natural leathers and artificial leathers without any particular limitation. If being shrunk anisotropically as described above, the grain-finished leather-like sheet is cut along the machine direction (MD) into strings having a width of 2 to 10 mm.

The artificial leather strings of the invention have a breaking strength comparable to that of natural leathers. In addition, the defects such as cracking of surface are minimized because the artificial leather strings are produced without drawing, and therefore, a good aesthetic appearance of the surface is maintained. The artificial leather strings are suitable for the production of clothes and woven or knitted fabrics for interior products and suitable for use as laces of shoes, bags and baseball gloves and braids for fancyworks. For example, the lace made of the artificial leather string of the invention is not broken and difficult to be unknotted.

(E) Antique-looking Semigrain-finished Leather-like Sheet

The antique-looking semigrain-finished leather-like sheet of the invention is composed of an entangled nonwoven fabric comprising three-dimensionally entangled fiber bundles containing microfine long fibers and an elastic polymer contained in the entangled nonwoven fabric, and simultaneously satisfies the following requirements 1 to 4:

(1) an average fineness of the microfine long fibers is 0.001 to 2 dtex;

(2) an average fineness of the fiber bundles of the microfine long fibers is 0.5 to 10 dtex; and (3) at least part of the microfine long fibers which form a surface layer and a back layer are fuse-bonded to each other, and the microfine long fibers which form a substrate layer 2 are not fuse-bonded, when the grain-finished leather-like sheet is divided to five layers with equal thickness, surface layer, substrate layer 1, substrate layer 2, substrate layer 3 and back layer, in this order along a thickness direction thereof; and (4) microfine long fibers separated from the bundle extend substantially in a horizontal direction on an outer surface of the surface layer and/or the back layer and cover 50% by area or less of the outer surface, wherein a bundle in first to tenth bundles in a thickness direction from the outer surface of the semigrain-finished leather-like sheet is separated into the microfine long fibers.

The antique-looking semigrain-finished leather-like sheet of the invention is produced by a method including the following steps (1e) to (6e):

(1e) a step of producing a long fiber web comprising microfine fiber bundle-forming long fibers by using sea-island long fibers;

(2e) a step of producing an entangled web by entangling the long fiber web;

(3e) a step of producing an entangled nonwoven fabric by removing a sea component from the microfine fiber bundle-forming long fibers in the entangled web, thereby converting the microfine fiber bundle-forming long fibers to bundles having an average single fiber fineness of 0.5 to 10 dtex and containing microfine long fibers having an average fineness of 0.001 to 2 dtex;

(4e) a step of providing the entangled nonwoven fabric with an aqueous dispersion or solution of an elastic polymer in an elastic polymer/microfine long fiber mass ratio of 0.001 to 0.6, and allowing the elastic polymer to migrate to both surfaces of the entangled nonwoven fabric and coagulate under heating, thereby obtaining a leather-like sheet;

(5e) a step of forming a grain surface by hot pressing both surfaces of the leather-like sheet at a temperature which is 50° C. or more lower than a spinning temperature of the sea-island long fibers and equal to or less than a melting point of the elastic polymer; and (6e) a step of raising a top surface and/or a back surface;

wherein the steps 1e, 2e, 3e, 4e, 5e and 6e or the steps 1e, 2e, 3e, 6e, 4e and 5e are sequentially performed in these orders.

In Step 4e, the impregnated amount of the aqueous solution or dispersion of the elastic polymer is 0.001 to 0.6, preferably 0.01 to 0.5 when expressed by a ratio by mass of the coagulated elastic polymer and the microfine long fibers.

In the production of the antique-looking semigrain-finished leather-like sheet, it is preferred to raise the top surface and/or the back surface of the entangled nonwoven fabric after the microfiberization step (Step 3e) and before the optional dyeing step and the step of providing the elastic polymer (Step 4e). The raising step (Step 6e) may be conducted after the step of forming the grain surface (Step 5e). The raising step is conducted by a known method such as a buffing treatment using sandpaper or a card clothing, a brushing treatment and a mechanical crumpling treatment. By the raising step, the bundles of microfine fibers on the outer surfaces (top surface and back surface) are separated into individual microfine fibers which extend substantially horizontally to cover part of the outer surfaces.

The other features of the antique-looking semigrain-finished leather-like sheet and its production method are as described above.

The entangled nonwoven fabric may be dyed with a disperse dye, if necessary, after conducting Steps 1e, 2e and 3e and before a step of providing the aqueous dispersion or solution of the elastic polymer (Step 4e), or after conducting Steps 1e, 2e, 3e and 6e and before Step 4e. The details of the disperse dye, dyeing method and dyeing conditions are mentioned above.

As described above, the raising step (Step 6e) may be conducted after Step 5e. When Steps 1e, 2e, 3e, 4e, 5e and 6e are conducted in this order, the top surface and/or the back surface may be embossed between Steps 5e and 6e. When Steps 1e, 2e, 3e, 6e, 4e and 5e are conducted in this order, the top surface and/or the back surface may be embossed between Steps 6e and 4e or between Steps 4e and 5e.

The sheet obtained in Step 5e or 6e is embossed by a method in which the sheet is pressed by a press roll onto an emboss sheet having a pebble and valley pattern or a method in which the sheet is pressed by passing a roll nip between a heated emboss roll having a pebble and valley pattern and a back roll disposed opposite to the emboss roll, although not particularly limited thereto. A metal roll is used as the emboss roll. The back roll may be a metal roll or an elastomer roll, with the elastomer roll being preferred because the embossing is successfully made. The embossing pressure and temperature are selected so as to successfully form the emboss pattern on the sheet. Generally, the embossing is conducted under a line pressure of 1 to 1000 N/mm at 130 to 250° C. After embossing, the sheet is cooled and released from the emboss roll after its surface becomes not flowable, to obtain an embossed semigrain-finished leather-like sheet. If released when the surface is still flowable, the embossed pattern is deformed and the debossing occurs, failing to obtain a sharp embossed pattern. Therefore, it is recommended to use a cooling liquid-circulating emboss roll or an emboss roll having a structure for forcedly cooling the position at which the sheet is released from the roll. The thickness of the embossed or non-embossed semigrain-finished leather-like sheet is preferably 100 μm to 6 mm.

Figure 7:
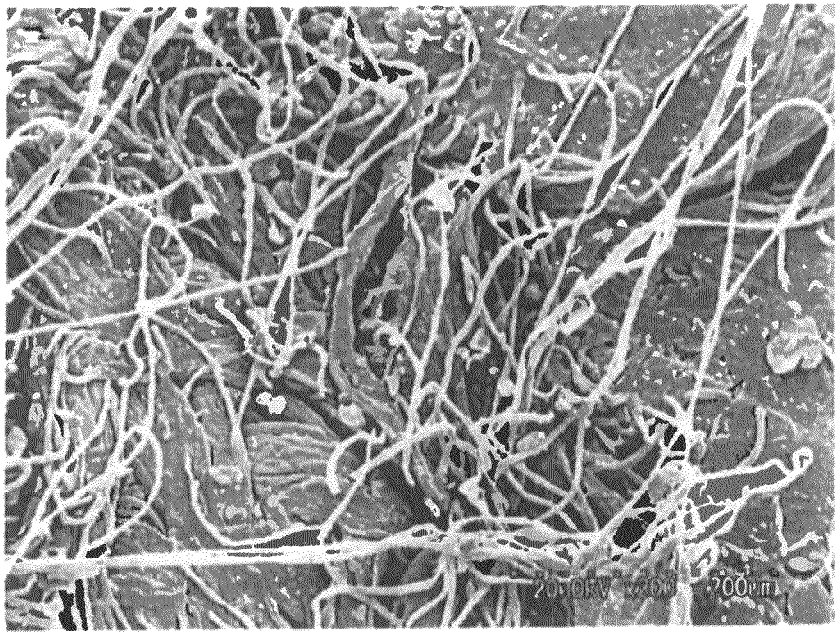
FIG. 7 is a scanning electron microphotograph (×200) showing the outer surface of the semigrain-finished leather-like sheet of the invention after a crumpling treatment.

FIG. 7 is a scanning electron microphotograph of the outer surface of the antique-looking semigrain-finished leather-like sheet of the invention. As seen from FIG. 7, the bundles of microfine fibers are exposed to the outer surface of the semigrain-finished leather-like sheet and a part thereof is separated or opened into individual microfine long fibers particularly by the raising step (Step 6e). The separated free microfine long fibers (not bound in the fiber bundle) extend in the horizontal direction (direction parallel to the surface of the semigrain-finished leather-like sheet) and partly cover the outer surface of the surface layer and/or the back layer. One of the ends of the free microfine long fibers penetrates the elastic polymer and extends toward the substrate layer. As compared with the napped fibers of the known semigrain-finished leather-like sheet, the relatively free microfine long fibers generated by separating or opening the bundles of microfine fibers are more movable upon bending, crumpling and rubbing. With such an outer surface which is partly covered with the movable microfine long fibers generated by separation or opening, the semigrain-finished leather-like sheet of the invention easily acquires an antique appearance resembling that of natural leathers without a long term use.

The microfine long fibers generated by separation or opening covers the outer surface in a areal ratio of 50% or less, preferably 10 to 50%, and more preferably 15 to 45% of the outer surface. Within the above ranges, an antique appearance resembling that of natural leathers is easily obtained. A bundle in the first to tenth bundles, preferably a bundle in the first to fifth bundles in the thickness direction from the outer surface of the semigrain-finished leather-like sheet is separated or opened into individual microfine long fibers. As described above, since only the bundles in the outer surface portion of the grain-finished leather-like sheet are separated and the inner bundles are not separated, an appearance clearly distinguished from a suede finish, i.e., an intermediate appearance of the grain finish and the suede finish (semigrain-finished appearance) is easily obtained. The effect of the present invention is obtained when at least one bundle in the first to tenth bundles, preferably at least one bundle in the first to fifth bundles is separated as long as the outer surface is covered with the microfine long fibers generated by the separation within the above range, and the ratio of the separated bundles is not particularly limited. In addition, the microfine long fibers in one fiber bundle are not needed to be all separated into individual microfine long fibers.

The antique-looking semigrain-finished leather-like sheet of the invention combines a low compression resistance and a dense feel each comparable to those of natural leathers and easily forms an antique appearance resembling that of natural leathers, and therefore, is suitably used in an application requiring an antique appearance such as clothes, shoes, bags, furniture, car seat, gloves, and briefcases.

EXAMPLES

The present invention will be described with reference to examples. However, it should be noted that the scope of the present invention is not limited thereto. The terms "part(s)" and "%" used in examples are based on mass as far as otherwise noticed. Each property was measure by the following method.

(1) Average Fineness of Microfine Long Fibers

The average cross-sectional area of 20 microfine long fibers constituting a leather-like sheet was obtained under a scanning electron microscope (several hundreds to several thousand of magnification). The average fineness was calculated from the obtained average cross-sectional area and the density of the polymer constituting the fibers.

(2) Average Fineness of Bundles

The average cross-sectional area of normal 20 bundles selected from the bundles constituting an entangled nonwoven fabric was determined from the radius of the circumcircle of the bundle which was measured under a scanning electron microscope (several hundreds to several thousand of magnification). The average fineness of the bundles was calculated from the density of the polymer constituting the fibers while assuming that the average cross-sectional area was filled up with the polymer.

(3) Melting Point

Using a differential scanning calorimeter (TA3000 manufactured by Mettler Co. Ltd.), a sample was heated to 300 to 350° C. according to the kind of polymer at a temperature rising rate of 10° C./min in nitrogen atmosphere, cooled to room temperature immediately, and then, heated again to 300 to 350° C. at a temperature rising rate of 10° C./min (2nd run). The peak top temperature of the obtained endothermic peak (melting peak) was taken as the melting point.

(4) Temperature of Endothermic Subpeak

Using a differential scanning calorimeter (TA3000 manufactured by Mettler Co. Ltd.), a sample was heated to 300 to 350° C. at a temperature rising rate of 10° C./min in nitrogen atmosphere (1st run). The peak top temperature of the obtained endothermic peak at low temperature side of the melting peak was taken as the temperature of endothermic subpeak.

(5) Peak Temperature of Loss Elastic Modulus

A film of the elastic polymer having a thickness of 200 μm was heat-treated at 130° C. for 30 min and then subjected to a viscoelastic measurement using an FT Rheospectoler DVE-V4 (Rheology Co.) at a frequency of 11 Hz and a temperature rising speed of 3° C./min to obtain a peak temperature of loss elastic modulus.

(6) Hot-Water Swelling at 130° C.

A film of the elastic polymer having a thickness of 200 μm was immersed in a hot water at 130° C. for 60 min under pressure, cooled to 50° C., and then taken out by a pair of tweezers. After wiping off the excessive water, the film was weighed. The hot-water swelling is expressed by the ratio of the increased weight to the weight before immersion.

(7) Content of Elastic Polymer

A grain-finished leather-like sheet was divided into five equal layers. The sample of each layer was subjected to elemental analysis to obtain a total nitrogen amount. The content was calculated from the obtained total nitrogen amount and the nitrogen amount in the elastic polymer.

(8) Bonding State of Elastic Polymer to Microfine Long Fibers

The grain-finished leather-like sheet dyed with osmium oxide was cross-sectionally observed under a S-2100 Hitachi scanning electron microscope (×100 to ×2000) at ten or more positions to determine the bonding state of the elastic polymer to fibers.

(9) Fastness to Wet Rubbing

Measured according to JIS L-0801 in wet condition and evaluated according to ratings.

(10) Fastness to Dry Rubbing

Measured according to JIS L-0801 in dry condition and evaluated according to ratings.

(11) Wet Peel Strength

The surface of a rubber plate of 15 cm long, 2.7 cm wide and 4 mm thick was buffed with a #240 sandpaper to sufficiently roughen the surface. A 100:5 mixed solution of a solvent-type adhesive (US-44) and a crosslinking agent (Desmodur RE) was applied onto the roughened surface of the rubber plate and one surface of a test piece of 25 cm long (lengthwise direction of a sheet) and 2.5 cm wide in 12 cm long by using a glass rod. After drying in a dryer at 100° C. for 4 min, the applied surfaces of the rubber plate and test pieces were bonded to each other. After pressing by a press roller and then curing at 20° C. for 24 h, the rubber plate/test piece was immersed in distilled water for 10 min. Each of the rubber plate and the test piece was held at its one end with a chuck, and the rubber plate and the test piece were peeled off at ensile speed of 50 mm/min using a tensile tester. The average wet peel strength was determined from the flat portion of the obtained stress-strain curve (SS curve). The results are shown by the average of three test pieces.

(12) Tensile Strength at 100% Elongation

A film with about 0.1 mm thick was formed on a flat release paper. From a portion of uniform thickness, a sample of 5 mm wide and 100 mm long was taken. The thickness was measured according to JIS L1096:1999 8.5.1 "Testing Methods for Woven Fabrics" under a load of 23.5 kPa. After moisture-conditioning the sample for 24 h or more (20° C., 65% relative humidity), the sample was held with upper and lower chucks at its lengthwise ends so as to avoid sagging (chuck interval: 50 mm). Then, the sample was pulled at a constant tensile speed of 25 mm/min (50% elongation/min), and the tensile strength at 100% elongation (chuck interval: 100 mm) was measured.

(13) Elongation at Tensile Break

A film with about 0.1 mm thick was formed on a flat release paper. From a portion of uniform thickness, a sample of 25 mm wide and 100 mm long was taken. The thickness was measured according to JIS L1096:1999 8.5.1 "Testing Methods for Woven Fabrics" under a load of 23.5 kPa. After moisture-conditioning the sample for 24 h or more (20° C., 65% relative humidity), the sample was held with upper and lower chucks at its lengthwise ends so as to avoid sagging (chuck interval: 50 mm). Then, the sample was pulled at a constant tensile speed of 25 mm/min (50% elongation/min), and the elongation at break was measured.

(14) Air Permeability

Measured according to JIS L-1096b using a Gurley B-Type Densometer (Toyo Seiki Seisaku-Sho, Ltd.).

(15) Moisture Permeability ($g/m^2 \cdot 24$ h)

Measured according to JIS K-6549.

(16) Width and Number of Fine Voids

The surface of a leather-like sheet was observed under a scanning electron microscope (about×800 to×2000) to measure the width of 20 voids with irregular shape surrounded by microfine fibers, thereby determining the maximum width and the minimum width. Then, the fine voids in a given area (100 μm×100 μm) were counted and the count of fine voids was converted into the number of fine voids per 1 $cm^2$ surface.

(17) Static Coefficient of Friction

Dry Condition

On a test piece which had been left in a standard condition (20° C. and 60% RH) for 24 h or more, a friction element of a thoroughly dried polyethylene spongy (L-2500) was placed, which was then loaded at 1320 g. The polyethylene spongy under load was pulled (200 mm/min) in the horizontal direction by an Autograph (Shimazu Co.) via a pulley to obtain a stress-moved distance curve. The dry static coefficient of friction was determined from the initial maximum stress and the load.

Wet Condition

The wet static coefficient of friction was determined in the same manner except for using a polyethylene spongy which had been immersed in an artificial sweat (acidic: JIS L0848) for 2 s as the friction element.

(18) Dynamic Coefficient of Friction

A stress-moved distance curve in each of dry and wet conditions was obtained in the same manner as in the measurement 17. The dynamic coefficient of friction in each of dry and wet conditions was determined from the average stress and the load.

(19) Apparent Density

A sample of 16 cm×16 cm was precisely weighed to three decimal places to determine the mass per unit area ($g/m^2$). Then, the thickness was measured according to JIS using a compressing element with 8 mm diameter under a load of 240 $g/m^2$. The apparent density was calculated from the mass per unit area and the thickness.

(20) Breaking Strength

A test piece of 25.4 mm×150 mm was pulled until broken using a Shimazu Autograph AGS-100 under a chuck interval of 100 mm at a tensile speed of 300 mm/min. The stress at break (maximum) was read from the obtained stress-elongation curve. The breaking strength was expressed by the average value of three measurements.

Production Example 1

Production of Water-soluble, Thermoplastic Polyvinyl Alcohol Resin

A 100-L pressure reactor equipped with a stirrer, a nitrogen inlet, an ethylene inlet and an initiator inlet was charged with 29.0 kg of vinyl acetate and 31.0 kg of methanol. After raising the temperature to 60° C., the reaction system was purged with nitrogen by bubbling nitrogen for 30 min. Then, ethylene was introduced so as to adjust the pressure of the reactor to 5.9 kgf/cm$^2$. A 2.8 g/L methanol solution of 2,2'-azobis(4-methoxy-2,4-dimethylvaleronitrile) (initiator) was purged with nitrogen by nitrogen gas bubbling. After adjusting the temperature of reactor to 60° C., 170 mL of the initiator solution was added to initiate the polymerization. During the polymerization, the pressure of reactor was maintained at 5.9 kgf/cm$^2$ by introducing ethylene, the polymerization temperature was maintained at 60° C., and the initiator solution was continuously added at a rate of 610 mL/h. When the conversion of polymerization reached 70% after 10 h, the polymerization was terminated by cooling. After releasing ethylene from the reactor, ethylene was completely removed by bubbling nitrogen gas.

The non-reacted vinyl acetate monomer was removed under reduced pressure to obtain a methanol solution of ethylene-modified polyvinyl acetate (modified PVAc), which was then diluted to 50% concentration with methanol. To 200 g of the 50% methanol solution of the modified PVAc, 46.5 g of a 10% methanol solution of NaOH was added to carry out a saponification (NaOH/vinyl acetate unit=0.10/1 by mole). After about 2 min of the addition of NaOH, the system was gelated. The gel was crushed by a crusher and allowed to stand at 60° C. for one hour to allow the saponification to further proceed. Then, 1000 g of methyl acetate was added to neutralize the remaining NaOH. After confirming the completion of neutralization by phenolphthalein indicator, white solid was separated by filtration. The white solid was added with 1000 g of methanol and allowed to stand at room temperature for 3 h for washing. After repeating the above washing operation three times, the solvent was centrifugally removed and the solid remained was dried in a dryer at 70° C. for 2 days to obtain an ethylene-modified polyvinyl alcohol (modified PVA). The saponification degree of the modified PVA was 98.4 mol %. The modified PVA was incinerated and dissolved in an acid for analysis by atomic-absorption spectroscopy. The content of sodium was 0.03 part by mass based on 100 parts by mass of the modified PVA.

After repeating three times the precipitation-dissolution operation in which n-hexane is added to the methanol solution of the modified PVA and acetone is then added for dissolution, the precipitate was vacuum-dried at 80° C. for 3 days to obtain a purified, modified PVAc. The purified, modified PVAc was dissolved in d6-DMSO and analyzed by 500 MHz H-NMR (JEOL GX-500) at 80° C. The content of ethylene unit was 10 mol %. After saponifying the modified PVAc (NaOH/vinyl acetate units=0.5 by mol), the gel was crushed and the saponification was allowed to further proceed by standing at 60° C. for 5 h. The saponification product was extracted by Soxhlet with methanol for 3 days and the obtained extract was vacuum-dried at 80° C. for 3 days to obtain a purified, modified PVA. The average polymerization degree of the purified, modified PVA was 330 when measured by a method of JIS K6726. The content of 1,2-glycol linkage and the content of three consecutive hydroxyl groups in the purified, modified PVA were respectively 1.50 mol % and 83% when measured by 5000 MHz H-NMR (JEOL GX-500). A 5% aqueous solution of the purified, modified PVA was made into a cast film of 10 μm thick, which was then vacuum-dried at 80° C. for one day and then measured for the melting point in the manner described above. The melting point was 206° C.

Example 1

The modified PVA (water-soluble, thermoplastic polyvinyl alcohol resin: sea component) and isophthalic acid-modified polyethylene terephthalate having a modification degree of 6 mol % (island component) were extruded from a spinneret for melt composite spinning (number of island: 25/fiber) at 260° C. in a sea component/island component ratio of 25/75 (by mass). The ejector pressure was adjusted such that the spinning speed was 3700 m/min, and partially oriented sea-island long fibers having an average fineness of 2.0 dtex were collected on a net, to obtain a long fiber web having a mass per unit area of 30 g/m$^2$.

After providing an oil agent, the long fiber web was cross-lapped into 18 layers to prepare a superposed web having a total mass per unit area of 540 g/m$^2$ which was then sprayed with an oil agent for preventing needle break. The superposed web was needle-punched in a density of 2400 punch/cm$^2$ alternatively from both sides using 6-barb needles with a distance of 3.2 mm from the tip end to the first barb at a punching depth of 8.3 mm, to produce an entangled web. The areal shrinkage by the needle punching was 85% and the mass per unit area of the entangled web after the needle punching was 628 g/m$^2$.

The entangled web was allowed to areally shrink by immersing it in a hot water at 70° C. for 20 s while taking up it at a line speed of 10 m/min. Then, the entangled web was subjected to a dip-nip treatment repeatedly in a hot water at 95° C. to remove the modified PVA by dissolution, to produce an entangled nonwoven fabric composed of three-dimensionally entangled fiber bundles each having an average fineness of 2.4 dtex and containing 25 microfine long fibers. After drying, the areal shrinkage was 49%, the mass per unit area was 942 g/m$^2$, the apparent density was 0.48 g/cm$^3$, and the peel strength was 5.8 kg/25 mm. The endothermic subpeak of the microfine long fibers forming the entangled nonwoven fabric was found at 115° C., and the areal ratio of the melting peak (238° C.) and the endothermic subpeak was 51:4.

The entangled nonwoven fabric was buffed into a thickness of 1.70 mm and then dyed brown by a disperse dye in a dyeing concentration of 5% owf. The process passing property (no pull-out and no raveling of fibers during dyeing operation and no pull-out of fibers during buffing operation) was good and an entangled nonwoven fabric of microfine long fibers dyed well was obtained.

An aqueous dispersion having a solid concentration of 10% by mass was prepared using a polyurethane (elastic polymer having a melting point of 180 to 190° C., a peak temperature of loss elastic modulus of −15° C., and a hot-water swelling at 130° C. of 35%) in which the soft segment was a 70:30 mixture of polyhexylene carbonate diol and polymethylpentene diol and the hard segment was mainly a hydrogenated methylene diisocyanate. The aqueous dispersion was impregnated into the dyed entangled nonwoven fabric in an elastic polymer/microfine long fiber mass ratio of 5:95, dried by blowing a hot air at 120° C. onto the top and back surfaces while simultaneously allowing the elastic polymer to migrate toward the top and back surfaces, and coagulated. Then, the top and back surfaces of the obtained leather-like sheet was hot-pressed by a metal roll at 172° C. to form a grain surface (fiber grain surface), thereby producing a grain-finished leather-like sheet.

The grain-finished leather-like sheet was divided into five equal layers along the thickness direction. The content (based on mass) of the elastic polymer in each layer was 26% (surface layer), 15% (substrate layer 1), 11% (substrate layer 2), 15% (substrate layer 3), and 33% (back layer). The obtained grain-finished leather-like sheet had a low compression resistance, a dense feel and a softness each resembling natural leathers and formed fine bent wrinkles upon bending which closely imitated those of natural leathers. The fastness to wet rubbing was grade 4, showing that the properties were sufficient for use as interior products and car seats.

Example 2

A grain-finished leather-like sheet was produced in the same manner as in Example 1 except for hot-pressing one surface of the elastic polymer-containing leather-like sheet by a metal roll at 172° C. (the opposite surface was in contact with a non-heated rubber roll) to fuse-bond only the fibers in the surface layer which exhibited an endothermic subpeak at 148° C. As in Example 1, the obtained grain-finished leather-like sheet had a low compression resistance, a dense feel and a softness each resembling those of natural leathers.

Example 3

The grain-finished leather-like sheet produced in Example 1 was sliced into two equal parts at the center of the thickness direction and the sliced surface was buffed with a #240 sandpaper into a thickness of 0.8 mm. As in Example 1, the obtained grain-finished leather-like sheet had a low compression resistance and a softness each resembling those of natural leathers and further had a surface property enough to be applied particularly to bags and balls.

Comparative Example 1

Using a 10 mol % isophthalic acid-modified polyethylene terephthalate (melting point: 234° C.) as the island compound and a polyvinyl alcohol copolymer (Exceval of Kuraray Co., Ltd., ethylene unit content: 10 mol %, saponification degree: 98.4 mol %, melting point: 210° C.) as the sea component, sea-island fibers of 64 islands with a sea/islands ratio of 30/70 by mass were composite melt-spun at a spinning temperature (spinneret temperature) of 260° C. and then taken up at a speed of 720 m/min. The spun fibers were then drawn at 100° C. by 2.5 times to obtain fibers having a fineness of 5.5 dtex and containing the island component having a fineness of 0.06. The obtained fibers were crimped, cut into staples of 51 mm long, carded, needle-punched, allowed to dry-shrink at 190° C. by an areal ratio of 20%, and hot-pressed at 175° C., to obtain a fibrous entangled body having a mass per unit area of 1080 g/cm$^2$, an apparent density of 0.64 g/cm$^3$, and an average thickness of 1.68 mm.

A gray water-dispersible pigment (Ryudye W Gray of Dainippon Ink & Chemicals, Inc.) and an aqueous emulsion of an ether-type polyurethane (Superflex E-4800 of Dai-Ichi Kogyo Seiyaku Co., Ltd.) were mixed in a pigment/emulsion ratio of 1.8/100 by mass of solid components to prepare an water dispersion of the elastic polymer having a concentration of 40% by mass and a viscosity of 10 cP. The water dispersion was impregnated into the fibrous entangled body in a microfiberized fibrous entangled body/elastic polymer ratio of 70/30 by mass. After coagulating and drying in a hot-air dryer at 160° C. for 3.5 min, the polyvinyl alcohol copolymer was extracted by a hot water at 90° C., to obtain an artificial leather substrate.

Then, after buffing to a thickness of 1.30 mm, the artificial leather substrate was dyed brown by a disperse dye in a dyeing concentration of 5% owf. The obtained leather-like sheet was hot-pressed by a metal roll at 172° C. on the top and back surfaces. However, only part of the polyurethane was made into a film and the fibers were not fuse-bonded to each other. Thus, it was difficult to form a flat grain surface (fiber grain surface). In addition, the fibrous entangled body of microfine staple fibers produced by removing the sea component from the fibrous entangled body before provided with the aqueous dispersion did not show the endothermic subpeak.

Comparative Example 2

Using polyethylene terephthalate (melting point: 251° C.) as the island component and a linear low density polyethylene (melting point: 110° C.) as the sea component, sea-island fibers of 64 islands with a sea/islands ratio of 40/60 by mass were composite melt-spun at a spinning temperature (spinneret temperature) of 310° C. and then taken up at a speed of 900 m/min. The spun fibers were then drawn at 90° C. by 1.5 times to obtain fibers having a fineness of 4.2 dtex. The obtained fibers were allowed to areally shrink by 38% in a hot water at 90° C., dried at 150° C. in a tenter, and calendered at 180° C. to obtain a fibrous entangled body having a mass per unit area of 1180 g/m$^2$, an apparent density of 0.47 g/cm$^3$, and an average thickness of 2.50 mm.

The obtained entangled nonwoven fabric was impregnated with a 15% dimethylformamide (DMF) solution of a polyethylene-type polyurethane (melting point: 160° C.) which was wet-coagulated by a mixed solution of DMF/water (1/5 by mass). After washing with water, the polyethylene sea component was removed by dissolving in toluene at 85° C., to produce a substrate for artificial leather having a mass per unit area of 847 g/m$^2$ and a thickness of 1.84 mm. The obtained substrate for artificial leather was sliced into two equal parts, and the sliced surface was buffed by a #180 sandpaper into a thickness of 0.8 mm. Then the opposite surface was successively buffed with a #240 sandpaper twice and a #400 sandpaper twice, to obtain a non-dyed suede-finished artificial leather having napped fibers of polyester microfine fibers having a single fiber fineness of 0.05 to 0.15 dtex, which was then dyed brown by a disperse dye in a dyeing concentration of 8.7% owf. The process passing property (no pull-out and no raveling of fibers during dyeing operation and no pull-out of fibers during buffing operation) was good and an entangled nonwoven fabric of microfine long fibers dyed well was obtained. The obtained leather-like sheet was hot-pressed by a metal roll at 175° C. on its top and back surfaces. However, the fibers in the surface was not fuse-bonded, but the polyurethane inside the sheet was fuse-bonded, to obtain a plate-like sheet with an extremely hard hand, which was quite unlike natural leathers. In addition, the obtained leather-like sheet and the microfine fiber sheet obtained by removing the polyurethane from the leather-like sheet before the hot press did not exhibit the endothermic subpeak.

Example 4

The modified PVA (water-soluble, thermoplastic polyvinyl alcohol resin: sea component) and isophthalic acid-modified polyethylene terephthalate having a modification degree of 6 mol % (island component) were extruded from a spinneret for melt composite spinning (number of island: 12/fiber) at 260° C. in a sea component/island component ratio of 25/75 (by mass). The ejector pressure was adjusted such that the spinning speed was 3800 m/min, and partially oriented sea-island long fibers having an average fineness of 2.1 dtex were collected on a net, to obtain a long fiber web having a mass per unit area of 31 g/m$^2$.

After providing an oil agent, the long fiber web was cross-lapped into 16 layers to prepare a superposed web having a total mass per unit area of 501 g/m$^2$ which was then sprayed with an oil agent for preventing needle break. The superposed web was needle-punched in a density of 2360 punch/cm$^2$ alternatively from both sides using 6-barb needles with a distance of 3.2 mm from the tip end to the first barb at a punching depth of 8.3 mm, to produce an entangled web. The areal shrinkage by the needle punching was 88% and the mass per unit area of the entangled web after the needle punching was 564 g/m$^2$.

The entangled web of long fibers was allowed to areally shrink by immersing it in a hot water at 70° C. for 15 s while taking up it at a line speed of 10 m/min. Then, the entangled web was subjected to a dip-nip treatment repeatedly in a hot water at 95° C. to remove the modified PVA by dissolution, to produce an entangled nonwoven fabric composed of three-dimensionally entangled fiber bundles each having an average fineness of 2.5 dtex and containing 12 microfine long fibers. After drying, the areal shrinkage was 47%, the mass per unit area was 798 g/m$^2$, the apparent density was 0.47 g/cm$^3$, and the peel strength was 5.7 kg/25 mm. The endothermic subpeak of the microfine long fibers forming the entangled nonwoven fabric was found at 118° C., and the areal ratio of the melting peak (236° C.) and the endothermic subpeak was 25:2.

The entangled nonwoven fabric was buffed into a thickness of 1.70 mm and then dyed brown by a disperse dye in a dyeing concentration of 2.75% owf. The process passing property (no pull-out and no raveling of fibers during dyeing operation and no pull-out of fibers during buffing operation) was good and an entangled nonwoven fabric of microfine long fibers dyed well was obtained.

An aqueous dispersion having a solid concentration of 10% by mass was prepared using a self-emulsifiable acrylic resin (melting point: 180 to 200° C., hot-water swelling at 130° C.: 20%, peak temperature of loss elastic modulus: −9° C., tensile strength at 100% elongation: 0.8 N/cm$^2$, elongation at tensile break: 270%) in which the soft component was ethyl acrylate and the hard component was methyl methacrylate. The aqueous dispersion was impregnated into the dyed entangled nonwoven fabric in a (meth)acrylic elastic polymer/microfine long fiber mass ratio of 8:92, dried by blowing a hot air at 120° C. onto the top and back surfaces while simultaneously allowing the (meth)acrylic elastic polymer to migrate toward the top and back surfaces, and coagulated. Then, the top and back surfaces of the obtained leather-like sheet was hot-pressed by a metal roll at 177° C. to form a grain surface (fiber grain surface), thereby producing a grain-finished leather-like sheet.

The grain-finished leather-like sheet was divided into five equal layers along the thickness direction. The content (based on mass) of the (meth)acrylic elastic polymer in each layer was 46% (surface layer), 6% (substrate layer 1), 2% (substrate layer 2), 5% (substrate layer 3), and 41% (back layer). The obtained grain-finished leather-like sheet had a low compression resistance, a dense feel and a softness each resembling natural leathers, caused the color change like oil up at bent portions and formed fine bent wrinkles which closely imitated those of natural leathers. The fastness to wet rubbing was grade 4 to 5, showing that the properties were sufficient for use as interior products and car seats.

Example 5

The modified PVA (water-soluble, thermoplastic polyvinyl alcohol resin: sea component) and isophthalic acid-modified polyethylene terephthalate having a modification degree of 6 mol % (island component) were extruded from a spinneret for melt composite spinning (number of island: 25/fiber) at 264° C. in a sea component/island component ratio of 30/70 (by mass). The ejector pressure was adjusted such that the spinning speed was 3900 m/min, and partially oriented sea-island long fibers having an average fineness of 1.5 dtex were collected on a net, to obtain a long fiber web having a mass per unit area of 32 g/m$^2$.

After providing an oil agent, the long fiber web was cross-lapped into 16 layers to prepare a superposed web having a total mass per unit area of 512 g/m$^2$ which was then sprayed with an oil agent for preventing needle break. The superposed web was needle-punched in a density of 2400 punch/cm$^2$ alternatively from both sides using 6-barb needles with a distance of 3.2 mm from the tip end to the first barb at a punching depth of 8.3 mm, to produce an entangled web. The areal shrinkage by the needle punching was 84% and the mass per unit area of the entangled web after the needle punching was 606 g/m$^2$.

The entangled web of long fibers was allowed to areally shrink by immersing it in a hot water at 72° C. for 30 s while taking up it at a line speed of 12 m/min. Then, the entangled web was subjected to a dip-nip treatment repeatedly in a hot water at 95° C. to remove the modified PVA by dissolution, to produce an entangled nonwoven fabric composed of three-dimensionally entangled fiber bundles each having an average fineness of 1.7 dtex and containing 25 microfine long fibers. After drying, the areal shrinkage was 40%, the mass per unit area was 722 g/m$^2$, the apparent density was 0.56 g/cm$^3$, and the peel strength was 5.2 kg/25 mm. The endothermic subpeak of the microfine long fibers forming the entangled nonwoven fabric was found at 116° C., and the areal ratio of the melting peak (237° C.) and the endothermic subpeak was 10:1.

The entangled nonwoven fabric was buffed into a thickness of 1.15 mm and then dyed dark brown by a disperse dye in a dyeing concentration of 5.2% owf. The process passing property (no pull-out and no raveling of fibers during dyeing operation and no pull-out of fibers during buffing operation) was good and an entangled nonwoven fabric of microfine long fibers dyed well was obtained.

An aqueous dispersion having a solid concentration of 10% by mass was prepared using a self-emulsifiable acrylic resin (melting point: 180 to 190° C., peak temperature of loss elastic modulus: −10° C., hot-water swelling at 130° C.: 45%) in which the soft component was butyl acrylate and the hard component was methyl methacrylate. The aqueous dispersion was impregnated into the dyed entangled nonwoven fabric in an elastic polymer/microfine long fiber mass ratio of 6.3:93.7, dried by blowing a hot air at 120° C. onto the top and back surfaces while simultaneously allowing the elastic polymer to migrate toward the top and back surfaces. Then, the surface was hot-pressed by a metal roll at 172° C. to form a grain surface (fiber grain surface), thereby producing a grain-finished leather-like sheet having a dense feel resembling natural leathers.

The grain-finished leather-like sheet thus produced was divided into five equal layers in the thickness direction. The content of the elastic polymer of each layer was, from the top layer, 46% (surface layer), 12% (substrate layer 1), 6% (substrate layer 2), 7% (substrate layer 3), and 29% (back layer). The grain-finished leather-like sheet had a low compression resistance, a dense feel and a softness each resembling natural leathers and was sufficiently fit for the use as a grain-finished artificial leather. The observation of the surface of the leather-like sheet under an electron microscope showed that the fine voids surrounded by the microfine fibers having a maximum width of 0.1 to 50 μm and a minimum width of 10 μm or less existed on the surface in a density of 50000 voids or more per 1 $cm^2$. The air permeability was 1.97 $cc/cm^2/sec$ and the moisture permeability at 30° C. and 80% RH was 1865 $g/m^2 \cdot 24$ h. The surface abrasion loss was 0 mg when measured by Martindale method under a load of 12 kPa ($gf/cm^2$) at 50,000 times of abrasions. The fastness to wet rubbing was grade 3.5, showing that the properties were sufficient for use as artificial leather products such as shoes, gloves, interior products and saddles. Particularly, the grain-finished leather-like sheet was suitable for artificial leather products such as shoes and gloves which were worn in contact with human skin and required to have a reduced damp and hot feeling.

Example 6

The modified PVA (water-soluble, thermoplastic polyvinyl alcohol resin: sea component) and isophthalic acid-modified polyethylene terephthalate having a modification degree of 8 mol % (island component) were extruded from a spinneret for melt composite spinning (number of island: 12/fiber) at 265° C. in a sea component/island component ratio of 30/70 (by mass). The ejector pressure was adjusted such that the spinning speed was 3500 m/min, and partially oriented sea-island long fibers having an average fineness of 2.5 dtex were collected on a net, to obtain a long fiber web having a mass per unit area of 30 $g/m^2$.

After providing an oil agent, the long fiber web was cross-lapped into 12 layers to prepare a superposed web having a total mass per unit area of 360 $g/m^2$ which was then sprayed with an oil agent for preventing needle break. The superposed web was needle-punched in a density of 2400 $punch/cm^2$ alternatively from both sides using 6-barb needles with a distance of 3.2 mm from the tip end to the first barb at a punching depth of 8.3 mm, to produce an entangled web. The areal shrinkage by the needle punching was 83% and the mass per unit area of the entangled web after the needle punching was 425 $g/m^2$.

The entangled web was allowed to areally shrink by immersing it in a hot water at 75° C. for 30 s while taking up it at a line speed of 10 m/min. Then, the entangled web was subjected to a dip-nip treatment repeatedly in a hot water at 95° C. to remove the modified PVA by dissolution, to produce an entangled nonwoven fabric composed of three-dimensionally entangled fiber bundles each having an average fineness of 2.8 dtex and containing 12 microfine long fibers. After drying, the areal shrinkage was 40%, the mass per unit area was 762 $g/m^2$, the apparent density was 0.58 $g/cm^3$, and the peel strength was 5.4 kg/25 mm. The endothermic subpeak of the microfine long fibers forming the entangled nonwoven fabric was found at 115° C., and the areal ratio of the melting peak (238° C.) and the endothermic subpeak was 25:2.

The entangled nonwoven fabric was buffed into a thickness of 1.20 mm and then dyed brown by a disperse dye in a dyeing concentration of 7.15% owf. The process passing property (no pull-out and no raveling of fibers during dyeing operation and no pull-out of fibers during buffing operation) was good and an entangled nonwoven fabric of microfine long fibers dyed well was obtained.

An aqueous dispersion having a solid concentration of 8% by mass was prepared using a self-emulsifiable acrylic resin (melting point: 185 to 195° C., peak temperature of loss elastic modulus: ±5° C., hot-water swelling at 90° C.: 55%) in which the soft component was butyl acrylate and the hard component was methyl methacrylate. The aqueous dispersion was impregnated into the dyed entangled nonwoven fabric in an elastic polymer/microfine long fiber mass ratio of 4.3:95.7, dried by blowing a hot air at 125° C. onto the top and back surfaces while simultaneously allowing the elastic polymer to migrate toward the top and back surfaces, and coagulated. Then, the top and back surfaces of the obtained leather-like sheet was hot-pressed by a metal roll at 177° C. to form a grain surface (fiber grain surface), thereby producing a grain-finished leather-like sheet.

The grain-finished leather-like sheet was divided into five equal layers in the thickness direction. The content (based on mass) of the elastic polymer in each layer was 43% (surface layer), 12% (substrate layer 1), 5% (substrate layer 2), 7% (substrate layer 3), and 33% (back layer). The obtained grain-finished leather-like sheet had a low compression resistance, a dense feel and a softness each resembling natural leathers and was sufficiently fit for the use as a grain-finished artificial leather. The following measured coefficients of friction showed that the leather-like sheet had a good wet grippability and was suitable for game balls.

Static Coefficient of Friction
dry condition: 0.435
wet condition: 0.498
Dynamic Coefficient of Friction
dry condition: 0.277
wet condition: 0.397

Example 7

The modified PVA (water-soluble, thermoplastic polyvinyl alcohol resin: sea component) and isophthalic acid-modified polyethylene terephthalate having a modification degree of 6 mol % (island component) were extruded from a spinneret for melt composite spinning (number of island: 12/fiber) at 268° C. in a sea component/island component ratio of 25/75 (by mass). The ejector pressure was adjusted such that the spinning speed was 4000 m/min, and partially oriented sea-island long fibers having an average fineness of 2.2 dtex were collected on a net, to obtain a long fiber web having a mass per unit area of 34 $g/m^2$.

After providing an oil agent, the long fiber web was cross-lapped into 34 layers to prepare a superposed web having a total mass per unit area of 1120 $g/m^2$ which was then sprayed with an oil agent for preventing needle break. The superposed web was needle-punched in a density of 2400 $punch/cm^2$ alternatively from both sides using 6-barb needles with a distance of 3.2 mm from the tip end to the first barb at a punching depth of 8.3 mm, to produce an entangled web. The areal shrinkage by the needle punching was 80% and the mass per unit area of the entangled web after the needle punching was 1239 $g/m^2$.

The entangled web was allowed to areally shrink by immersing it in a hot water at 75° C. for 60 s while taking up it at a line speed of 10 m/min. Then, the entangled web was subjected to a dip-nip treatment repeatedly under tension in the machine direction (MD) in a hot water at 95° C. to remove the modified PVA by dissolution, to produce an entangled nonwoven fabric composed of three-dimensionally entangled fiber bundles each having an average fineness of 2.4 dtex and containing 12 microfine long fibers. After drying, the areal shrinkage was 39%, the mass per unit area was 1620 $g/m^2$, the apparent density was 0.58 $g/cm^3$, and the wet peel strength was 8.3 kg/25 mm. The endothermic subpeak of the microfine long fibers forming the entangled nonwoven fabric was found at 116° C., and the areal ratio of the melting peak (240° C.) and the endothermic subpeak was 26:2.

The entangled nonwoven fabric was buffed into a thickness of 2.55 mm and then dyed dark brown by a disperse dye in a dyeing concentration of 7.15% owf. The process passing property (no pull-out and no raveling of fibers during dyeing operation and no pull-out of fibers during buffing operation) was good and an entangled nonwoven fabric of microfine long fibers dyed well was obtained.

An aqueous dispersion having a solid concentration of 20% by mass was prepared using a self-emulsifiable acrylic resin (melting point: 183 to 193° C., peak temperature of loss elastic modulus: −8° C., hot-water swelling at 130° C.: 42%) in which the soft component was butyl acrylate and the hard component was methyl methacrylate. The aqueous dispersion was impregnated into the dyed entangled nonwoven fabric in an elastic polymer/microfine long fiber mass ratio of 12:88, dried by blowing a hot air at 120° C. onto the top and back surfaces while simultaneously allowing the elastic polymer to migrate toward the top and back surfaces, and coagulated. Then, the top and back surfaces of the obtained leather-like sheet was hot-pressed by a metal roll at 177° C. to form a grain surface (fiber grain surface), thereby producing a grain-finished leather-like sheet having an apparent density of 0.67 g/cm$^3$ and a thickness of 2.44 mm.

The grain-finished leather-like sheet was divided into five equal layers in the thickness direction. The content (based on mass) of the elastic polymer in each layer was 46% (surface layer), 9% (substrate layer 1), 4% (substrate layer 2), 7% (substrate layer 3), and 34% (back layer). The obtained grain-finished leather-like sheet had a low compression resistance, a dense feel and a softness each resembling natural leathers and was sufficiently fit for the use as a grain-finished artificial leather. The leather-like sheet was cut along the machine direction (MD) to strings of 5 mm wide. The breaking strength of the string was 30 kg/5 mm. Thus, the string had a high strength comparable to that of natural leathers, which was suitable for use as a lace of baseball gloves.

Example 8

The modified PVA (water-soluble, thermoplastic polyvinyl alcohol resin: sea component) and isophthalic acid-modified polyethylene terephthalate having a modification degree of 8 mol % (island component) were extruded from a spinneret for melt composite spinning (number of island: 25/fiber) at 260° C. in a sea component/island component ratio of 25/75 (by mass). The ejector pressure was adjusted such that the spinning speed was 3700 m/min, and partially oriented sea-island long fibers having an average fineness of 1.8 dtex were collected on a net, to obtain a long fiber web having a mass per unit area of 28 g/m$^2$.

After providing an oil agent, the long fiber web was cross-lapped into 10 layers to prepare a superposed web having a total mass per unit area of 280 g/m$^2$ which was then sprayed with an oil agent for preventing needle break. The superposed web was needle-punched in a density of 2400 punch/cm$^2$ alternatively from both sides using 6-barb needles with a distance of 3.2 mm from the tip end to the first barb at a punching depth of 8.3 mm, to produce an entangled web. The areal shrinkage by the needle punching was 85% and the mass per unit area of the entangled web after the needle punching was 315 g/m$^2$.

The entangled web was allowed to areally shrink by immersing it in a hot water at 70° C. for 20 s while taking up it at a line speed of 10 m/min. Then, the entangled web was subjected to a dip-nip treatment repeatedly in a hot water at 95° C. to remove the modified PVA by dissolution, to produce an entangled nonwoven fabric composed of three-dimensionally entangled fiber bundles each having an average fineness of 2.1 dtex and containing 25 microfine long fibers. After drying, the areal shrinkage was 51%, the mass per unit area was 504 g/m$^2$, the apparent density was 0.46 g/cm$^3$, and the peel strength was 6.4 kg/25 mm. The endothermic subpeak of the microfine long fibers forming the entangled nonwoven fabric was found at 114° C., and the areal ratio of the melting peak (239° C.) and the endothermic subpeak was 49:4.

The entangled nonwoven fabric was buffed into a thickness of 0.90 mm and then dyed brown by a disperse dye in a dyeing concentration of 4.62% owf. The process passing property (no pull-out and no raveling of fibers during dyeing operation and no pull-out of fibers during buffing operation) was good and an entangled nonwoven fabric of microfine long fibers dyed well was obtained.

An aqueous dispersion having a solid concentration of 6% by mass was prepared using a self-emulsifiable acrylic resin (melting point: 190 to 200° C., peak temperature of loss elastic modulus: −5° C., hot-water swelling at 130° C.: 50%) in which the soft component was butyl acrylate and the hard component was methyl methacrylate. The aqueous dispersion was impregnated into the dyed entangled nonwoven fabric in an elastic polymer/microfine long fiber mass ratio of 4.6:95.4, dried by blowing a hot air at 120° C. onto the top and back surfaces while simultaneously allowing the elastic polymer to migrate toward the top and back surfaces, and coagulated. Then, the top and back surfaces of the obtained leather-like sheet was hot-pressed by a metal roll at 176° C. to form a grain surface (fiber grain surface), thereby producing a grain-finished leather-like sheet.

The obtained grain-finished leather-like sheet was divided into five equal layers in the thickness direction. The content (based on mass) of the elastic polymer in each layer was 48% (surface layer), 11% (substrate layer 1), 5% (substrate layer 2), 8% (substrate layer 3), and 28% (back layer). The obtained grain-finished leather-like sheet had a low compression resistance, a dense feel and a softness each resembling natural leathers and was sufficiently fit for the use as artificial leathers.

The leather-like sheet was provided with a deep emboss pattern resembling calfskin on its surface and crumpled to separate few bundles on the outer surface portion to individual microfine fibers. The obtained semigrain-finished leather-like sheet exhibited an antique appearance apparently after a long term use although immediately after its production, and was difficult to distinguish from natural leathers in both hand and appearance. The semigrain-finished leather-like sheet was excellent in mechanical properties and had a fastness to dry rubbing of grade 4.5 and a fastness to wet rubbing of grade 4, enough for use as interior products and car seat.

Industrial Applicability

In the (semi)grain-finished leather-like sheet of the invention, the microfine long fibers forming the surface layer and/or the back layer are fuse-bonded to each other, but the microfine long fibers forming the intermediate layer are not fuse-bonded. With such a fuse-bonding state of the microfine long fibers, the (semi)grain-finished leather-like sheet combines a low compression resistance and a dense feel comparable to those of natural leathers, had a sufficient practical strength and was excellent in properties required in respective applications. The (semi)grain-finished leather-like sheet is applicable to a wide range of use such as clothes, shoes, bags, furniture, car seat, gloves, briefcases, curtains, game balls, laces of shoes, briefcases and baseball gloves, braids for fancyworks, and antique-looking leather products.

What is claimed is:

1. A grain-finished leather-like sheet which comprises an entangled nonwoven fabric comprising three-dimensionally entangled fiber bundles containing microfine long fibers and an elastic polymer contained in the entangled nonwoven fabric, wherein the grain-finished leather-like sheet simultaneously satisfies the following requirements 1 to 3:

(1) an average fineness of the microfine long fibers of 0.001 to 2 dtex:

(2) an average fineness of the fiber bundles of the microfine long fibers of 0.5 to 10 dtex; and (3) wherein the grain-finished leather-like sheet has five sections designated as the following five layers of equal thickness: a surface layer, a substrate layer 1, a substrate layer 2, a substrate layer 3 and a back layer, in this order along a thickness direction thereof a part of the microfine long fibers which form at least one of the surface layer and the back layer are fuse-bonded to each other such that the fuse-bonded microfine long fibers form a non-napped grain surface, and the microfine long fibers which form the substrate layer 2 are not fuse-bonded.

2. The grain-finished leather-like sheet according to claim 1, wherein the elastic polymer has a hot-water swelling at 130° C. of 10% or more and a peak temperature of loss elastic modulus of 10° C. or less.

3. The grain-finished leather-like sheet according to claim 1, which further simultaneously satisfies the following requirement 4:

(4) the elastic polymer is a (meth)acrylic elastic polymer having a hot-water swelling at−130° C. of 10%- or more, a peak temperature of loss elastic modulus of 10° C. or less, a tensile strength at 100% elongation of 2 N/cm$^2$ or less, and an elongation at tensile break of 100% or more.

4. The grain-finished leather-like sheet according to claim 1, which simultaneously satisfies the requirement 1 wherein the average fineness is 0.001 to 0.5 dtex, the requirement 2 wherein the average fineness of the bundles of microfine long fibers is 0.5 to 4 dtex, the requirement 3, and further, the following requirements 4 and 5:

(4) fine voids surrounded by the microfine fibers having a maximum width of 0.1 to 50 μm and a minimum width of 10 μm or less exist 8000 or more per 1 cm$^2$ of surface, and (5) a surface abrasion loss of 30 mg or less when measured by Martindale method under a load of 12 kPa (gf/cm$^2$) at 50,000 times of abrasions.

5. The grain-finished leather-like sheet according to claim 1, which simultaneously satisfies the requirement 1 wherein the average fineness is 0.005 to 2 dtex, the requirement 2 wherein the average fineness of the bundles of microfine long fibers is 1.0 to 10 dtex, the requirement 3, and further, the following requirement 4:

(4) a static coefficient of friction and a dynamic coefficient of friction of a surface of the grain-finished leather-like sheet satisfy the following formulae I and II:

$$\text{static coefficient of friction(wet)} \geq \text{static coefficient of friction (dry)} \quad \text{(I)}$$

$$\text{dynamic coefficient of friction(wet)} \geq \text{dynamic coefficient of friction (dry)} \quad \text{(II)}.$$

6. The grain-finished leather-like sheet according to claim 1, which simultaneously satisfies the requirement 1 wherein the average fineness is 0.005 to 2 dtex, the requirement 2, the requirement 3, and further, the following requirements 4 and 5:

(4) an apparent density of the grain-finished leather-like sheet of 0.5 g/cm$^3$ or more, and (5) a string of the grain-finished leather-like sheet having a width of 5 mm, which is obtained by cutting the grain-finished leather-like sheet along a machine direction (MD) or a crossing direction (CD), and has a breaking strength of 1.5 kg/mm$^2$ or more.

7. The grain-finished leather-like sheet according to claim 6, wherein a breaking strength per unit cross-sectional area of a string having a width of 5 mm taken by cutting the grain-finished leather-like sheet along a machine direction (MD) is 1.3 to 5.0 times a breaking strength per unit-cross-sectional area of a string having a width of 5 mm taken by cutting the grain-finished leather-like sheet along a crossing direction (CD).

8. The grain-finished leather-like sheet according to claim 1, wherein at least part of the microfine long fibers which form the surface layer and the back layer are fuse-bonded to each other; a content of elastic polymer is 20 to 60% by mass in the surface layer, 2 to 30% by mass in the substrate layer 1, 0 to 20% by mass in the substrate layer 2, 2 to 30% by mass in the substrate layer 3 and 20 to 60% by mass in the back layer while setting a total content of elastic polymer in five layers 100% by mass; and the content of each of the surface layer and the back layer is at least 1.2 times the content of each of the substrate layer 1 and the substrate layer 3 and at least 1.5 times the content of the substrate layer 2.

9. The grain-finished leather-like sheet according to claim 1, wherein the microfine long fibers are obtained by removing a sea component from sea-island long fibers in which the sea component is a water-soluble, thermoplastic polyvinyl alcohol and an island component is a water-insoluble, thermoplastic polymer.

10. The grain-finished leather-like sheet according to claim 1, wherein the entangled nonwoven fabric simultaneously satisfies the following requirements 4 to 6:

(4) the inside of the bundles of microfine long fibers in at least one layer of the surface layer and the back layer is filled with the elastic polymer;

(5) the elastic polymer completely covers an outer surface of the bundles in at least one layer of the surface layer and the back layer; and (6) when the substrate layer 2 contains the elastic polymer, the inside of the bundles in the substrate layer 2 is not filled with the elastic polymer, and an outer surface of the bundles is not completely covered by the elastic polymer.

11. A grain-finished leather-like sheet comprising a surface layer, a substrate layer 1 and a substrate layer 2 which is obtained by cutting or abrading the grain-finished leather-like sheet as defined in claim 1 along a direction perpendicular to a thickness direction.

12. The grain-finished leather-like sheet according to claim 1, wherein the microfine long fibers are produced by spunbonding without cutting.

13. The grain-finished leather-like sheet according to claim 1, wherein the microfine long fibers have a melting peak and an endothermic subpeak whose temperature is lower than the melting point, and the fuse-bonded is caused by the endothermic subpeak.

14. A nonslip product wherein at least part thereof is formed from the grain-finished leather-like sheet as defined in claim 5.

15. The nonslip product according to claim 14, which is a game ball for basket ball or American football.

16. A semigrain-finished leather-like sheet which comprises an entangled nonwoven fabric comprising three-dimensionally entangled bundles of microfine long fibers and an elastic polymer contained in the entangled nonwoven fabric, wherein the semigrain-finished leather-like sheet simultaneously satisfies the following requirements 1 to 4:

(1) an average fineness of the microfine long fibers of 0.001 to 2 dtex;

(2) an average fineness of the bundles of the microfine long fibers of 0.5 to 10 dtex;

(3) wherein the grain-finished leather-like sheet has five sections designated as the following five layers of equal thickness: a surface layer, a substrate layer 1, a substrate layer 2, a substrate layer 3 and a back layer, in this order along a thickness direction thereof a part of the microfine long fibers which form at least one of the surface layer and the back layer are fuse-bonded to each other such that the fuse-bonded microfine long fibers form a non-napped grain surface, and the microfine long fibers which form the substrate layer 2 are not fuse-bonded, and (4) microfine long fibers separated from the bundle extend substantially in a horizontal direction on an outer surface of the surface layer and/or the back layer and cover 50% by area or less of the outer surface, wherein a bundle in first to tenth bundles in a thickness direction from the outer surface of the semigrain-finished leather-like sheet is separated into the microfine long fibers.

17. The semigrain-finished leather-like sheet according to claim 16, wherein at least part of the microfine long fibers which form the surface layer and the back layer are fuse-bonded to each other; a content of elastic polymer is 20 to 60% by mass in the surface layer, 2 to 30% by mass in the substrate layer 1, 0 to 20% by mass in the substrate layer 2, 2 to 30% by mass in the substrate layer 3 and 20 to 60% by mass in the back layer while setting a total content of elastic polymer in five layers 100% by mass; and the content of each of the surface layer and the back layer is at least 1.2 times the content of each of the substrate layer 1 and the substrate layer 3 and at least 1.5 times the content of the substrate layer 2.

18. The semigrain-finished leather-like sheet according to claim 16, wherein the entangled nonwoven fabric simultaneously satisfies the following requirements 5 to 7:

(5) inside of the bundles of microfine long fibers in at least one layer of the surface layer and the back layer is filled with the elastic polymer;

(6) the elastic polymer completely covers an outer surface of the bundles in at least one layer of the surface layer and the back layer; and (7) when the substrate layer 2 contains the elastic polymer, the inside of the bundles in the substrate layer 2 is not filled with the elastic polymer, and an outer surface of the bundles is not completely covered by the elastic polymer.

19. A semigrain-finished leather-like sheet comprising the surface layer, the substrate layer 1 and the substrate layer 2 which is obtained by cutting or abrading the semigrain-finished leather-like sheet as defined in claim 16 along a direction perpendicular to a thickness direction.

20. The semigrain-finished leather-like sheet according to claim 16, wherein the microfine long fibers are produced by spun-bonding without cutting.

21. The semigrain-finished leather-like sheet according to claim 16, wherein the microfine long fibers have a melting peak and an endothermic subpeak whose temperature is lower than the melting point, and the fuse-bonded is caused by the endothermic subpeak.

* * * * *